US011300025B2

(12) United States Patent
Volmerding et al.

(10) Patent No.: US 11,300,025 B2
(45) Date of Patent: Apr. 12, 2022

(54) SYSTEMS AND METHODS FOR REDUCING REDUCTANT DEPOSIT FORMATION IN A DECOMPOSITION REACTOR OF AN EXHAUST GAS AFTERTREATMENT SYSTEM FOR AN INTERNAL COMBUSTION ENGINE

(71) Applicant: Cummins Emission Solutions Inc., Columbus, IN (US)

(72) Inventors: Matthew K. Volmerding, Columbus, IN (US); Gaurav Hemant Pandit, Columbus, IN (US)

(73) Assignee: Cummins Emission Solutions Inc., Columbus, IN (US)

( * ) Notice: Subject to any disclaimer, the term of this patent is extended or adjusted under 35 U.S.C. 154(b) by 0 days.

(21) Appl. No.: 17/291,205

(22) PCT Filed: Nov. 5, 2019

(86) PCT No.: PCT/US2019/059761

§ 371 (c)(1),
(2) Date: May 4, 2021

(87) PCT Pub. No.: WO2020/097008

PCT Pub. Date: May 14, 2020

(65) Prior Publication Data

US 2021/0310394 A1 Oct. 7, 2021

Related U.S. Application Data

(60) Provisional application No. 62/756,195, filed on Nov. 6, 2018.

(51) Int. Cl.
*F01N 3/20* (2006.01)
*F01N 3/28* (2006.01)

(52) U.S. Cl.
CPC ..... *F01N 3/2013* (2013.01); *F01N 3/2073* (2013.01); *F01N 3/2892* (2013.01);
(Continued)

(58) Field of Classification Search
CPC ..... F01N 2610/1453; F01N 3/2892; F01N 3/206; B01D 2251/2067; B01F 2005/0017;
(Continued)

(56) References Cited

U.S. PATENT DOCUMENTS 3,792,669 A * 2/1974 Ueno ..... F02K 9/72 431/91
7,497,077 B2 * 3/2009 Dodge ..... F01N 3/2066 60/286
(Continued)

FOREIGN PATENT DOCUMENTS

CN 206577604 U 10/2017
CN 108729990 11/2018
(Continued)

OTHER PUBLICATIONS

Bernardin & Mudawar, "The Leidenfrost Point: Experimental Study and Assessment of Existing Models," Journal of Heat Transfer 121(4), pp. 849-903 (1999).
(Continued)

*Primary Examiner* — Anthony Ayala Delgado
(74) *Attorney, Agent, or Firm* — Foley & Lardner LLP

(57) ABSTRACT

An exhaust gas aftertreatment system includes a decomposition reactor, an injector, and a processor. The decomposition reactor includes a body, an impingement structure, and a heater. Exhaust gas is flowable through the body. The body includes an inlet and an outlet. The inlet is configured to receive the exhaust gas at a first temperature. The outlet is configured to selectively expel the exhaust gas at a second
(Continued)

temperature greater than the first temperature. The impingement structure is disposed within the body between the inlet and the outlet. The impingement structure extends into the body and is located such that the exhaust gas flowing through the body impinges on the impingement structure. The heater is coupled to the impingement structure and configured to selectively heat the impingement structure. The injector is configured to inject reductant into the body. The processor is programmed to control the heater.

19 Claims, 20 Drawing Sheets

(52) U.S. Cl.
CPC ..... *F01N 2240/16* (2013.01); *F01N 2240/20* (2013.01); *F01N 2610/02* (2013.01)

(58) Field of Classification Search
CPC ..... B01F 2005/0441; B01F 2005/0636; B01F 5/061; B01F 5/0451; G01N 27/4067; G01N 27/4175
See application file for complete search history.

(56) References Cited

U.S. PATENT DOCUMENTS

| | | | | |
|---|---|---|---|---|
| 7,712,304 | B2 | 5/2010 | Mayer et al. | |
| 8,033,714 | B2 | 10/2011 | Nishioka et al. | |
| 8,071,037 | B2 | 12/2011 | Harinath et al. | |
| 8,114,364 | B2 | 2/2012 | Harinath et al. | |
| 8,176,731 | B2 | 5/2012 | Doring et al. | |
| 9,016,050 | B2 | 4/2015 | Fischer et al. | |
| 9,132,385 | B2 | 9/2015 | Kwan | |
| 9,650,933 | B2 * | 5/2017 | Chiruta | F01N 3/2066 |
| 10,024,217 | B1 * | 7/2018 | Johnson | F01N 13/143 |
| 2005/0013756 | A1 * | 1/2005 | Amou | B01D 53/9495 423/239.1 |
| 2009/0229254 | A1 * | 9/2009 | Gibson | F01N 13/009 60/282 |
| 2010/0005791 | A1 * | 1/2010 | Ranganathan | F01N 3/36 60/310 |
| 2011/0079003 | A1 * | 4/2011 | Sun | F01N 3/2066 60/310 |
| 2012/0156105 | A1 | 6/2012 | Maus et al. | |
| 2012/0173062 | A1 * | 7/2012 | Madurai Kumar | B60W 10/26 701/22 |
| 2014/0050628 | A1 * | 2/2014 | Nakano | B01F 5/061 422/173 |
| 2014/0318108 | A1 * | 10/2014 | Boggs | F01N 13/0097 60/311 |
| 2014/0366509 | A1 | 12/2014 | Hirth et al. | |
| 2015/0101313 | A1 | 4/2015 | Mitchell et al. | |
| 2015/0315943 | A1 * | 11/2015 | Gschwind | B01F 5/0616 422/180 |
| 2015/0361849 | A1 * | 12/2015 | Chiruta | F01N 3/2892 60/301 |
| 2016/0076425 | A1 | 3/2016 | Goffe | |
| 2016/0129397 | A1 * | 5/2016 | Lee | F01N 3/2033 422/148 |
| 2017/0128885 | A1 | 5/2017 | Goffe | |
| 2017/0292430 | A1 * | 10/2017 | Clayton, Jr. | B01D 53/9495 |
| 2017/0356378 | A1 | 12/2017 | Hayashita et al. | |
| 2020/0032692 | A1 * | 1/2020 | Wang | F01N 3/0293 |
| 2020/0123955 | A1 * | 4/2020 | Liu | B01F 5/0485 |

FOREIGN PATENT DOCUMENTS

| | | |
|---|---|---|
| DE | 10 2012 004 267 | 9/2013 |
| EP | 0 894 523 A1 | 2/1999 |
| EP | 1 052 009 B1 | 4/2005 |
| EP | 1 748 162 A1 | 1/2007 |
| EP | 2 172 266 A1 | 4/2010 |
| EP | 2 282 027 A1 | 2/2011 |
| EP | 3 379 046 A1 | 9/2018 |
| WO | WO-2017/198601 A1 | 11/2017 |
| WO | WO-2019/191528 A1 | 10/2019 |

OTHER PUBLICATIONS

Continental Automotive, "Electrically Heated Catalyst EMICAT," 3 pages (2018).
Cristal, "Titanium Dioxide for Environmental Catalysis," 2 pages (2018).
Guido, et al., "A boiling heat transfer paradox," American Journal of Physics 60(7), pp. 593-597 (1992).
International Search Report & Written Opinion for PCT/US2019/059761 dated Jan. 27, 2020, 8 pages.
Mills & Fry, "Rate of evaporation of hydrocarbons from a hot surface: Nukiyama and Leidenfrost temperatures," European Journal of Physics 3(3), pp. 152-154 (1982).
Mills & Sharrock, "Rate of evaporation of n-alcohols from a hot surface: Nukiyama and Leidenfrost temperatures," European Journal of Physics 7(1), pp. 52-54 (1986).
Ramilison J.M. and Leinhard, J. H., "Transition Boiling Heat Transfer and the Film Transition Regime," Journal of Heat Transfer,vol. 109, pp. 746-752, Aug. 1987.
Smith, et al., "Advanced Spray Impingement Modelling for an Improved Prediction Accuracy of the Ammonia Homogenisation in SCR Systems," SAE Technical Paper 2015-01-1054, 19 pages (2015).
Strots, et al. "Deposit Formation in Urea-SCR Systems," SAE International Journal of Fuels and Lubricants, vol. 2, No. 2 (2010), pp. 283-289 (7 pages).
Vander Wal et al., "Droplet-Surface Impingement Dynamics for Intelligent Spray Design," Jun. 1, 2004; https://ntrs.nasa.gov/archive/nasa/casi.ntrs.nasa.gov/20040084180.pdf.
Walker, "Boiling and the Leidenfrost Effect," Cleveland State University, 4 pages.
First Office Action issued for German Patent Application No. DE 112019005545.3 dated Oct. 19, 2021, 5 pages.
First Office Action issued in Chinese Patent Application No. CN 201980072810.9 dated Nov. 1, 2021, 6 pages.

* cited by examiner

SYSTEMS AND METHODS FOR REDUCING REDUCTANT DEPOSIT FORMATION IN A DECOMPOSITION REACTOR OF AN EXHAUST GAS AFTERTREATMENT SYSTEM FOR AN INTERNAL COMBUSTION ENGINE

CROSS-REFERENCE TO RELATED APPLICATIONS

This application is a National phase application based on PCT/US2019/059761, filed Nov. 5, 2019, which claims priority to U.S. Provisional Patent Application No. 62/756,195 filed on Nov. 6, 2018. The contents of these applications are incorporated by references in their entirety and for all purposes.

TECHNICAL FIELD

The present application relates generally to systems and methods for reducing reductant deposit formation in a decomposition reactor of an exhaust gas aftertreatment system for an internal combustion engine.

BACKGROUND

For internal combustion engines, such as diesel engines, nitrogen oxide ($NO_x$) compounds may be emitted in exhaust gas. To reduce $NO_x$ emissions, a reductant may be dosed into the exhaust by a dosing system. The reductant may form deposits within the dosing system, such as within a decomposition reactor of the dosing system. Deposit formation may increase as a temperature of the exhaust gas decreases. The dosing system may become undesirable when an amount of deposits formed within the dosing system is above a threshold.

SUMMARY

In one embodiment, an exhaust gas aftertreatment system includes a decomposition reactor, an injector, and a processor. The decomposition reactor includes a body, an impingement structure, and a heater. Exhaust gas is flowable through the body. The body includes an inlet and an outlet. The inlet is configured to receive the exhaust gas at a first temperature. The outlet is configured to selectively expel the exhaust gas at a second temperature greater than the first temperature. The impingement structure is disposed within the body between the inlet and the outlet. The impingement structure extends into the body and is located such that the exhaust gas flowing through the body impinges on the impingement structure. The heater is coupled to the impingement structure and configured to selectively heat the impingement structure. The injector is configured to inject reductant into the body. The processor is programmed to control the heater so as to heat the impingement structure to a third temperature that is greater than a Leidenfrost temperature of the reductant.

In another embodiment, an exhaust gas aftertreatment system includes a decomposition reactor and a processor. The decomposition reactor includes a body, a guide, a flange, an inner tube, a temperature controlled catalyst, and a heater. Exhaust gas is flowable through the body. The body includes an inlet and an outlet. The inlet is configured to receive the exhaust gas. The outlet is configured to selectively expel the exhaust gas. The guide is coupled to the body downstream of the inlet. The guide extends into the body and includes a plurality of guide apertures configured to receive the exhaust gas from the inlet. The flange is coupled to the body downstream of the guide. The inner tube is coupled to the flange and the guide. The inner tube is configured to separately receive the exhaust gas from the inlet and the guide. The inner tube is also configured to provide the exhaust gas through the flange and towards the outlet. The temperature controlled catalyst is disposed within the inner tube downstream of the guide. The temperature controlled catalyst is located such that the exhaust gas passing through the inner tube towards the outlet impinges on the temperature controlled catalyst. The heater is coupled to the temperature controlled catalyst and configured to selectively heat the temperature controlled catalyst. The processor is programmed to control the heater so as to heat the temperature controlled catalyst to perform hydrolysis of the exhaust gas that impinges on the temperature controlled catalyst.

In another embodiment, a decomposition reactor for an exhaust gas aftertreatment system includes an inlet, an outlet, a body, an inner tube, a distribution plate, and a first heater. The inlet is configured to receive an exhaust gas. The outlet is configured to provide the exhaust gas. The body extends between the inlet and the outlet. The inner tube is positioned within the body such that at least a portion of the inner tube is separated from the body by an air gap extending around the inner tube. The inner tube includes an impingement structure positioned proximate the inlet. The distribution plate is coupled to the impingement structure. The first heater is coupled to the distribution plate. The distribution plate separates the first heater from the impingement structure.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
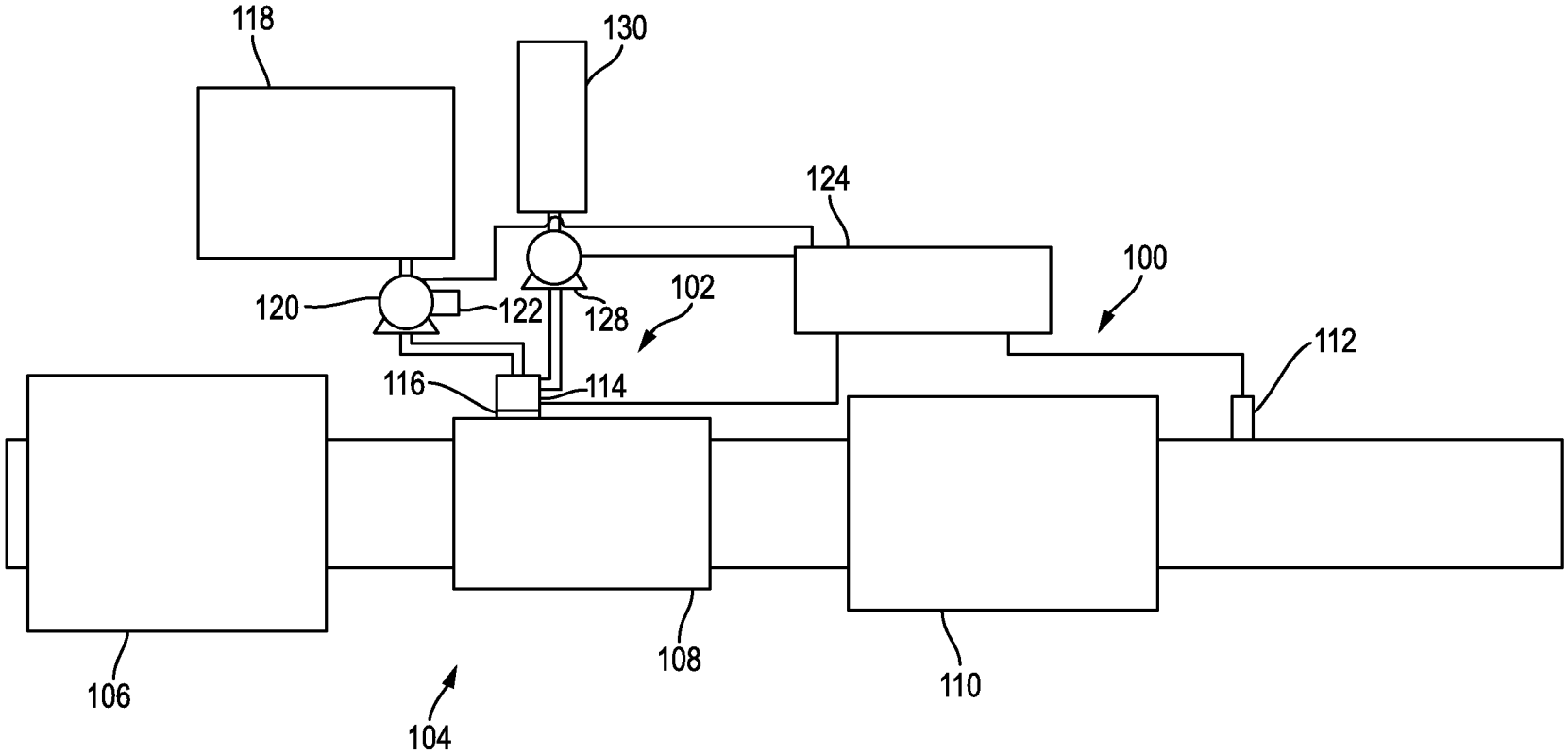
FIG. 1 is a block schematic diagram of an example exhaust gas aftertreatment system.

It will be recognized that some or all of the Figures are schematic representations for purposes of illustration. The Figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for reducing reductant deposit formation in a decomposition reactor of an exhaust gas aftertreatment system for an internal combustion engine. The various concepts introduced above and discussed in greater detail below may be implemented in any of numerous ways, as the described concepts are not limited to any particular manner of implementation. Examples of specific implementations and applications are provided primarily for illustrative purposes.

I. Overview

Internal combustion engines (e.g., diesel internal combustion engines, etc.) produce exhaust gas that is often treated by a doser within an exhaust gas aftertreatment system. Dosers typically treat exhaust gas using a reductant. The reductant is typically provided from the doser into a pipe or fitting which distributes (e.g., doses, etc.) the reductant into an exhaust stream within an exhaust component.

Treatment of exhaust gas with reductant alters the chemical composition of the exhaust gas so that combustion byproducts otherwise present in exhaust gas from an internal combustion engine are reduced. In some areas (e.g., countries, localities, regions, etc.), the amount of combustion byproducts that can be emitted into atmosphere (e.g., after being treated by an exhaust gas aftertreatment system, etc.) is regulated to a threshold amount. As the threshold amount is decreased (e.g., through the passing of new regulations, etc.), exhaust gas aftertreatment systems are typically reconfigured to dose exhaust gas with more reductant. While this additional reductant may be useful in initially reducing the amount of combustion byproducts, it may form deposits within the exhaust gas aftertreatment system at a rate that is increased relative to exhaust gas aftertreatment systems that dose exhaust gas with less reductant. Additionally, deposits are likely to accumulate much more quickly when the exhaust gas is of a lower temperature, such as before an internal combustion engine producing the exhaust gas is operating at steady state. Furthermore, the introduction of reductant into exhaust gas causes cooling of the exhaust gas. This cooled exhaust gas causes cooling of various surfaces within the exhaust gas aftertreatment system. This cooling can facilitate further deposit formation because deposits are more likely to form at lower temperatures.

As deposits accumulate within the exhaust gas aftertreatment system, the exhaust gas aftertreatment system may require service or cleaning or may require the use of a hydrocarbon dosing system, thereby making the exhaust gas aftertreatment system less desirable (e.g., due to costs associated with service, due to costs associated with cleaning, due to increased fuel consumption caused by use of a hydrocarbon dosing system, etc.). Accordingly, typical exhaust gas aftertreatment systems are likely to require increased service or cleaning, and therefore likely to become increasingly less desirable, as increased reductant is utilized because typical exhaust gas aftertreatment systems are unable to mitigate accumulation of deposits therein.

Implementations herein relate to decomposition reactors that include heaters which are configured to raise the surface temperature of various components within the decomposition chamber such that the formation of deposits on these components is mitigated or substantially eliminated. Some implementations described herein are related to impingement structures (e.g., surfaces that are cooled by reductant, surfaces that are located adjacent a reductant injector, surfaces that are downstream of a reductant injector, etc.) which include such heaters and which interact with the exhaust gas to alter the flow of the exhaust gas within the decomposition reactor. The impingement structure may be, or may include, an impingement surface. Other implementations described herein are related to a temperature controlled catalyst which includes such a heater and which interacts with the exhaust gas to alter the chemical composition thereof while the heater mitigates or substantially eliminates the formation of deposits on the temperature controlled catalyst. In these ways, the heater compensates for decreases in temperature that occur due to the reductant being provided into the exhaust gas.

By incorporating heaters into impingement structures and/or temperature controlled catalysts, an exhaust gas aftertreatment system can mitigate deposit formation regardless of other considerations, such as mixer design (e.g., distance between a tip of an injector and an impingement structure, an angle of an injector with respect to a center axis of an exhaust conduit, spray characteristics of an injector, thickness of an impingement structure, shapes and sizes or internal passages through which exhaust gas passes, etc.), engine operating characteristics (e.g., flow rate of exhaust gas, temperature of exhaust gas, etc.), and exhaust gas aftertreatment system operating characteristics (e.g., reductant dosing rate, temperature of reductant at injection, etc.). As a result, implementations described herein are significantly more desirable than other systems that do not incorporate heaters into impingement structures and/or temperature controlled catalysts because implementations described herein are capable of being used in a wide array of applications without significant modification.

II. Overview of Exhaust Gas Aftertreatment System

FIG. 1 depicts an exhaust gas aftertreatment system 100 having an example reductant delivery system 102 for an exhaust system 104. The exhaust gas aftertreatment system 100 includes a particulate filter (e.g., a diesel particulate filter (DPF), etc.) 106, the reductant delivery system 102, a decomposition chamber 108 (e.g., reactor, reactor pipe, etc.), a SCR catalyst 110, and a sensor 112.

The DPF 106 is configured to (e.g., structured to, able to, etc.) remove particulate matter, such as soot, from exhaust gas flowing in the exhaust system 104. The DPF 106 includes an inlet, where the exhaust gas is received, and an outlet, where the exhaust gas exits after having particulate matter substantially filtered from the exhaust gas and/or converting the particulate matter into carbon dioxide. In some implementations, the DPF 106 may be omitted.

The decomposition chamber 108 is configured to convert a reductant into ammonia (e.g., $NH_3$, etc.). The reductant may be, for example, urea, diesel exhaust fluid (DEF), Adblue®, an urea water solution (UWS), an aqueous urea solution (e.g., AUS32, AUS 40, etc.), and other similar fluids. The decomposition chamber 108 includes a reductant delivery system 102 having a doser or dosing module 114 configured to dose the reductant into the decomposition chamber 108 (e.g., via an injector). In some implementations, the reductant is injected upstream of the SCR catalyst 110. The reductant droplets then undergo the processes of evaporation, thermolysis, and hydrolysis to form gaseous ammonia within the exhaust system 104. The decomposition chamber 108 includes an inlet in fluid communication with the DPF 106 to receive the exhaust gas containing $NO_x$ emissions and an outlet for the exhaust gas, $NO_x$ emissions, ammonia, and/or reductant to flow to the SCR catalyst 110.

The decomposition chamber 108 includes the dosing module 114 mounted to the decomposition chamber 108 such that the dosing module 114 may dose the reductant into the exhaust gas flowing in the exhaust system 104. The dosing module 114 may include an insulator 116 interposed between a portion of the dosing module 114 and the portion of the decomposition chamber 108 on which the dosing module 114 is mounted. The dosing module 114 is fluidly coupled to (e.g., fluidly communicable with, etc.) a reductant source 118. The reductant source 118 may include multiple reductant sources 118. The reductant source 118 may be, for example, a diesel exhaust fluid tank containing Adblue®.

A supply unit or reductant pump 120 is used to pressurize the reductant from the reductant source 118 for delivery to the dosing module 114. In some embodiments, the reductant pump 120 is pressure controlled (e.g., controlled to obtain a target pressure, etc.). The reductant pump 120 includes a filter 122. The filter 122 filters (e.g., strains, etc.) the reductant prior to the reductant being provided to internal components (e.g., pistons, vanes, etc.) of the reductant pump 120. For example, the filter 122 may inhibit or prevent the transmission of solids (e.g., solidified reductant, contaminants, etc.) to the internal components of the reductant pump 120. In this way, the filter 122 may facilitate prolonged desirable operation of the reductant pump 120. In some embodiments, the reductant pump 120 is coupled to a chassis of a vehicle associated with the exhaust gas aftertreatment system 100.

The dosing module 114 and reductant pump 120 are also electrically or communicatively coupled to a controller 124. The controller 124 is configured to control the dosing module 114 to dose the reductant into the decomposition chamber 108. The controller 124 may also be configured to control the reductant pump 120. The controller 124 may include a microprocessor, an application-specific integrated circuit (ASIC), a field-programmable gate array (FPGA), etc., or combinations thereof. The controller 124 may include memory, which may include, but is not limited to, electronic, optical, magnetic, or any other storage or transmission device capable of providing a processor, ASIC, FPGA, etc. with program instructions. The memory may include a memory chip, Electrically Erasable Programmable Read-Only Memory (EEPROM), Erasable Programmable Read Only Memory (EPROM), flash memory, or any other suitable memory from which the controller 124 can read instructions. The instructions may include code from any suitable programming language.

The SCR catalyst 110 is configured to assist in the reduction of $NO_x$ emissions by accelerating a $NO_x$ reduction process between the ammonia and the $NO_x$ of the exhaust gas into diatomic nitrogen, water, and/or carbon dioxide. The SCR catalyst 110 includes an inlet in fluid communication with the decomposition chamber 108 from which exhaust gas and reductant are received and an outlet in fluid communication with an end of the exhaust system 104.

The exhaust system 104 may further include an oxidation catalyst (e.g., a diesel oxidation catalyst (DOC)) in fluid communication with the exhaust system 104 (e.g., downstream of the SCR catalyst 110 or upstream of the DPF 106) to oxidize hydrocarbons and carbon monoxide in the exhaust gas.

In some implementations, the DPF 106 may be positioned downstream of the decomposition chamber 108. For instance, the DPF 106 and the SCR catalyst 110 may be combined into a single unit. In some implementations, the dosing module 114 may instead be positioned downstream of a turbocharger, upstream of a turbocharger, or integrated within the turbocharger.

The sensor 112 may be coupled to the exhaust system 104 to detect a condition of the exhaust gas flowing through the exhaust system 104. In some implementations, the sensor 112 may have a portion disposed within the exhaust system 104; for example, a tip of the sensor 112 may extend into a portion of the exhaust system 104. In other implementations, the sensor 112 may receive exhaust gas through another conduit, such as one or more sample pipes extending from the exhaust system 104. While the sensor 112 is depicted as positioned downstream of the SCR catalyst 110, it should be understood that the sensor 112 may be positioned at any other position of the exhaust system 104, including upstream of the DPF 106, within the DPF 106, between the DPF 106 and the decomposition chamber 108, within the decomposition chamber 108, between the decomposition chamber 108 and the SCR catalyst 110, within the SCR catalyst 110, or downstream of the SCR catalyst 110. In addition, two or more sensors 112 may be utilized for detecting a condition of the exhaust gas, such as two, three, four, five, or six sensors 112 with each sensor 112 located at one of the aforementioned positions of the exhaust system 104. However, in other embodiments the reductant delivery system 102 does not include the sensor 112.

In some embodiments, the reductant delivery system 102 also includes an air pump 128. The air pump 128 draws air from an air source 130 (e.g., air intake, etc.). Additionally, the air pump 128 provides the air to the dosing module 114 via a conduit. The dosing module 114 is configured to mix the air and the reductant into an air-reductant mixture. The dosing module 114 is further configured to provide the air-reductant mixture into the decomposition chamber 108. However, in other embodiments the reductant delivery system 102 does not include the air pump 128 or the air source 130, and air is not mixed with the reductant in the dosing module 114.

Figure 2:
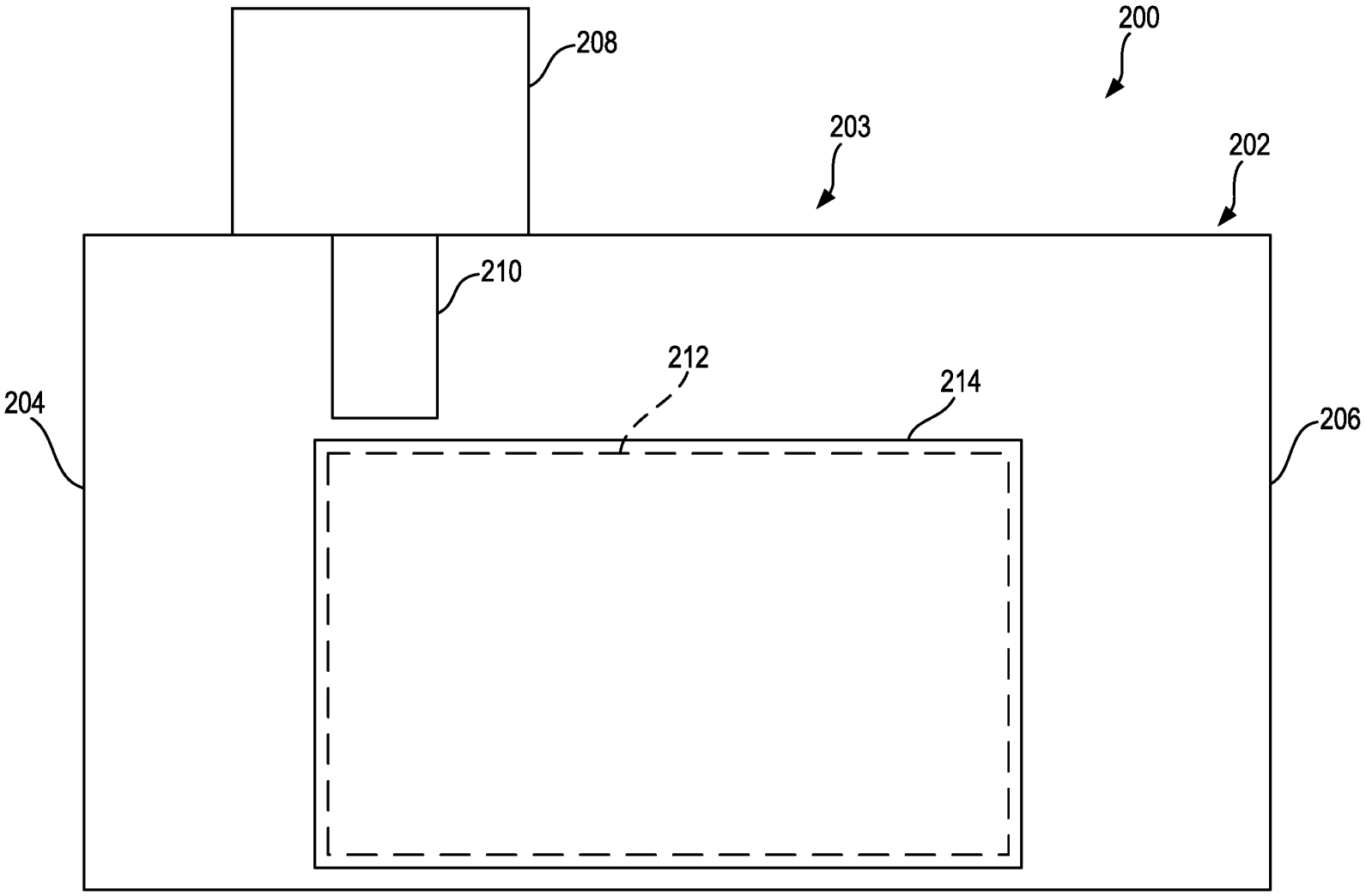
FIG. 2 is a cross-sectional view of an example decomposition reactor of an example exhaust gas aftertreatment system.

III. Example Exhaust Gas Aftertreatment System with Heater and Impingement Structures FIG. 2 illustrates a cross-sectional view of an exhaust gas aftertreatment system 200 (e.g., a UL2 exhaust gas aftertreatment system, an Emitec exhaust gas aftertreatment system, etc.). The exhaust gas aftertreatment system 200 may function as the exhaust gas aftertreatment system 100 previously described. The exhaust gas aftertreatment system 200 includes a decomposition reactor 202. The decomposition reactor 202 may function as the decomposition chamber 108 previously described. The decomposition reactor 202 includes a body 203 (e.g., frame, shell, etc.) having an inlet 204 (e.g., input, entrance, etc.) and an outlet 206 (e.g., outlet, exit, etc.). The inlet 204 is configured to receive the exhaust gas from an upstream component of the exhaust gas aftertreatment system 200, such as a DPF similar to the DPF 106 previously described. The outlet 206 is configured to provide a mixture of the exhaust gas and reductant (e.g., treated exhaust gas, etc.) to a downstream component of the exhaust gas aftertreatment system 200, such as a catalyst similar to the SCR catalyst 110 previously described.

The exhaust gas aftertreatment system 200 also includes a dosing module 208. The dosing module 208 may function as the dosing module 114 previously described. The dosing module 208 is configured to receive reductant from a reductant pump, similar to the reductant pump 120, which draws reductant from a reductant supply, similar to the reductant source 118. In some embodiments, the dosing module 208 also receives air from an air pump, similar to the air pump 128 previously described, which draws air from an air supply, similar to the air source 130.

The dosing module 208 includes an injector 210 (e.g., side mount injector, reductant injector, etc.) that is coupled to the body 203. The injector 210 is configured to inject reductant from the dosing module 208 into the decomposition reactor 202 so that the exhaust gas within the decomposition reactor 202 can be treated with the reductant. The injector 210 is not simply a pipe which routes reductant into the center of the decomposition reactor 202 (e.g., for deposition on a catalyst, etc.). Instead, the injector 210 is configured to inject reductant into the exhaust gas.

The amount of reductant dosed into the exhaust gas is related to a threshold amount of combustion byproducts that the exhaust gas aftertreatment system 200 emits into the atmosphere. In some applications, the exhaust gas aftertreatment system 200 is controlled such that the exhaust gas is dosed with a target amount of reductant such that a target amount of combustion byproducts, less than the threshold amount of combustion byproducts, is emitted by the exhaust gas aftertreatment system 200.

Reductant can form deposits in typical exhaust gas aftertreatment systems. These deposits can reduce the efficiency of the exhaust gas aftertreatment system. However, the exhaust gas aftertreatment system 200 includes a heater 212 (e.g., electric heater, resistance heater, etc.) can mitigate or substantially prevent the formation of deposits within the decomposition reactor 202 (e.g., can limit deposit formation to amounts that are less than 5% of the amount of deposits formed in typical exhaust gas aftertreatment systems using the same amount of reductant), thereby causing the exhaust gas aftertreatment system 200 to operate more efficiently than typical exhaust gas aftertreatment systems. The heater 212 provides additional heat to the exhaust gas that otherwise could not be provided.

The exhaust gas aftertreatment system 200 is particularly more desirable in applications where relatively large amounts of reductant are used to treat the exhaust gas, such as applications where regulations are imposed that dramatically limit the amount of combustion byproducts that an internal combustion engine is permitted to emit. In such applications, typical exhaust gas aftertreatment systems may quickly become less desirable due to rapid deposit formation which occurs because a large amount of reductant is used and no mechanism exists for preventing deposit formation or due to increased fuel consumption which occurs because a hydrocarbon dosing system is used to dose fuel into the exhaust gases. Additionally, the exhaust gas aftertreatment system 200 is particularly more desirable in applications where exhaust gas recirculation is not utilized. In such applications, typical exhaust gas aftertreatment systems may emit relatively high levels of combustion byproducts because exhaust gas recirculation is not utilized. These relatively high levels of combustion byproducts that would otherwise be emitted can be dramatically decreased by the exhaust gas aftertreatment system 200.

The benefits of the exhaust gas aftertreatment system 200 compared to a typical exhaust gas aftertreatment system are particularly present when treating relatively low temperature exhaust gas, such as exhaust gas emitted while an internal combustion engine is warming up. When typical exhaust gas aftertreatment systems are treating the same relatively low temperature exhaust gas, heating of the reductant by the exhaust gas is decreased, thereby increasing deposit formation.

Rather than merely heating the exhaust gas directly and heating surfaces within the decomposition reactor 202 indirectly (e.g., through the interaction with the heated exhaust gas, etc.), the heater 212 is configured to directly heat the impingement structures 214 of the decomposition reactor 202. The impingement structures 214 are surfaces within the decomposition reactor 202 that are coupled to the body 203 and that are in close proximity to (e.g., downstream of, underneath, etc.) the injector 210, where deposits are likely to form absent the heater 212. In various embodiments, the impingement structures 214 are surfaces of splash plates, surfaces of swirl plates, surfaces of swirl devices, surfaces of mixers, and other similar surfaces within the decomposition reactor 202.

In various embodiments, the heater 212 does not continuously heat the impingement structures 214 of the decomposition reactor 202. Instead, the heater 212 selectively heats the impingement structures 214. For example, where a difference between a temperature of the exhaust gases at the inlet 204 and a temperature of the exhaust gases at the outlet 206 is above a threshold, the heater 212 may not heat the impingement structures 214.

In some embodiments, the impingement structures 214 extend underneath the injector 210 and substantially prevent reductant from contacting the decomposition reactor 202. For example, the impingement structures 214 may be a plurality of overlapped plates that facilitate the flow of exhaust therethrough but are arranged to prevent reductant from being sprayed from the injector 210 downwards and onto the decomposition reactor 202.

The impingement structures 214 may be configured to have a minimal heat capacity (e.g., thermal capacitance, etc.). For example, the impingement structures 214 may be thin, small, and numerous (e.g., a plurality of thin and small plates, etc.). In this way, the impingement structures 214 may be quickly heated such that minimal pre-heating of the impingement structures 214 (e.g., before the reductant can be dosed into the exhaust gas, etc.) is necessary. Such configurations of the impingement structures 214 maximize the amount of exhaust gas that can be treated with reductant while deposit formation is mitigated or substantially prevented by the impingement structures 214.

The impingement structures 214 may have a higher than normal surface roughness (e.g., a surface roughness greater than that of a polished surface, etc.) in order to minimize deposit formation thereon. For example, the impingement structures 214 may be textured. The surface roughness of the impingement structures 214 in such embodiments causes droplets to break up into smaller droplets when approaching the impingement structures. These smaller droplets decompose faster than larger droplets, thereby decreasing the likelihood of deposit formation occurring. However, the surface roughness of the impingement structures 214 may also be maintained below a threshold surface roughness at which fluid movement along the impingement structures 214 is negatively impacted and at which heat transfer through the impingement structures 214 is negatively impacted.

Figure 3:
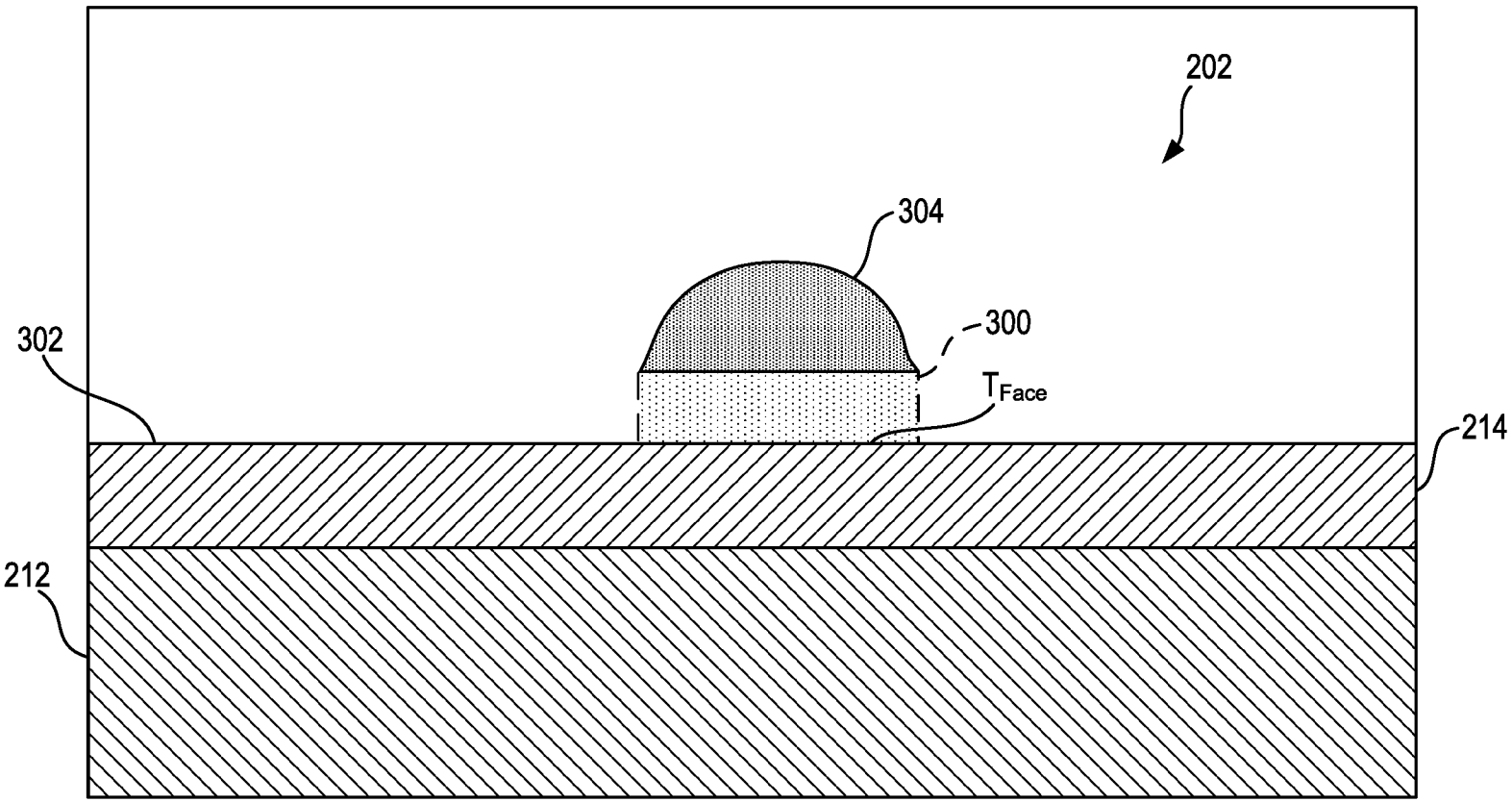
FIG. 3 is a detailed view of the decomposition reactor shown in FIG. 2.

FIG. 3 illustrates a detailed view of a cross section of an example impingement structure 214. In the embodiment shown in FIG. 3, the heater 212 is disposed within the impingement structure 214 such that a portion of the impingement structure 214 extends across and over the heater 212. In other embodiments, the heater 212 is embedded within the impingement structure 214 such that the heater 212 is exposed and not covered by the impingement structure 214. In other embodiments, the impingement structure 214 is the heater 212 itself (e.g., the heater 212 is formed and constructed to be the impingement structure 214, etc.).

As shown in FIG. 3, the heater 212 heats the impingement structure 214 such that a vapor layer 300 is formed between an exterior face 302 of the impingement structure 214 and a droplet 304 of reductant. It is understood that the exterior face 302 may be any combination of the impingement structure 214 and the heater 212, depending on whether the heater 212 is covered, partially covered, or not covered by the impingement structure 214.

The vapor layer 300 is formed from the droplet 304 via the Leidenfrost effect. The Leidenfrost effect occurs because a temperature $T_{Face}$ of the exterior face 302 is greater than a Leidenfrost temperature $T_L$ (e.g., a film boiling temperature, a Leidenfrost point, etc.) of the droplet 304, thereby causing a portion of the droplet 304 to vaporize and separate the droplet 304 from the exterior face 302. In this way, the exterior face 302 is separated from the droplets 304 such that deposit formation is mitigated or substantially prevented on the exterior face 302.

The vapor layer 300 has a thickness that is related to the temperature $T_{Face}$. The temperature $T_{Face}$ is related to a temperature of the heater 212, a thermal conductivity of the heater 212, a thermal conductivity of the impingement structure 214, and a thickness of the impingement structure 214 proximate the heater 212. The Leidenfrost temperature $T_L$ is related to a configuration of the exhaust gas aftertreatment system 200, a type of reductant, a temperature of the droplet 304, a Weber number of the droplet 304 (e.g., related to a mass of the droplet 304, a velocity of the droplet 304, a density of the droplet 304, and a surface tension of the droplet 304, etc.), a pressure within the decomposition reactor 202, a flow rate (e.g., volumetric flow rate, mass flow rate, etc.) of the exhaust gas through the decomposition reactor, a material of the exterior face 302, a surface roughness of the exterior face 302, and thermal properties (e.g., thermal conductivity, thickness, etc.) of the exterior face 302. Tables 1 and 2 outline the temperature $T_L$ according to various embodiments. In Tables 1 and 2, the polished surface roughness is lower than the unpolished surface roughness. By increasing the surface roughness, (e.g., in unpolished embodiments) the temperature $T_L$ typically decreases because the surface roughness causes a corresponding roughness in the vapor layers 300 which may break up droplets 304, thereby facilitating decomposition of the droplets 304 into the exhaust gas.

TABLE 1

Temperature $T_L$ for droplets 304 where the exterior face 302 is polished and unpolished when the exhaust gas aftertreatment system 200 is a UL2 exhaust gas aftertreatment system.

| Surface Roughness | Polished | | | Unpolished | | |
|---|---|---|---|---|---|---|
| Temperature $T_L$ [° C.] | 123.3 | 130.3 | 137.3 | 121 | 128.8 | 137.8 |

TABLE 2

Temperature $T_L$ for droplets 304 where the exterior face 302 is polished and unpolished when the exhaust gas aftertreatment system 200 is an Emitec exhaust gas aftertreatment system.

| Surface Roughness | Polished | | | Unpolished | | |
|---|---|---|---|---|---|---|
| Temperature $T_L$ [° C.] | 144.2 | 147.4 | 150.7 | 141 | 145.6 | 150.2 |

In some embodiments, the impingement structure 214 and/or the injector 210 is configured to facilitate an increased impact energy of the droplets 304 on the impingement structure 214 or to facilitate a higher Weber number. In these ways, the impingement structure 214 and/or the injector 210 may promote splashing, breakup of the droplets 304, and decomposition of the droplets 304 while minimizing deposit formation. If the impingement structure 214 and/or the injector 210 are configured in this fashion, the temperature $T_L$ may increase, requiring a corresponding increase in the temperature $T_{Face}$.

In addition to being maintained above the temperature $T_L$, the heater 212 is controlled such that the temperature $T_{Face}$ is maintained below an oxidation temperature $T_O$ of the reductant. The temperature $T_O$ is a temperature above which the reductant will oxidize. Oxidized reductant may negatively impact performance of an exhaust gas aftertreatment system, such as by reducing functionality of an SCR catalyst, such as the SCR catalyst 110, that is positioned downstream of the heater 212.

Figure 4:
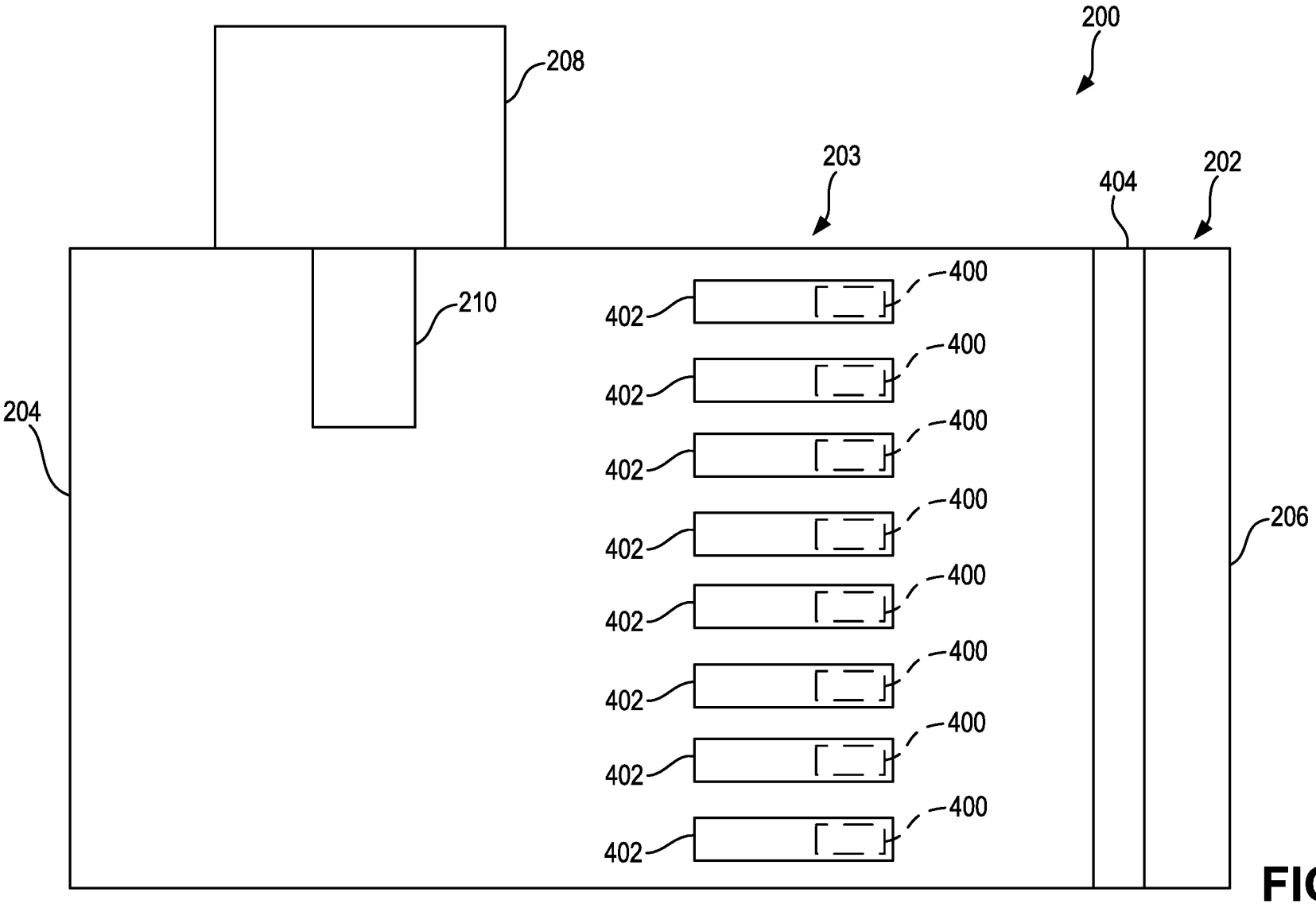
FIG. 4 is a cross-sectional view of an example decomposition reactor of an example exhaust gas aftertreatment system according to an embodiment.

FIG. 4 illustrates the decomposition reactor 202 in an example embodiment. The heater 212 and the impingement structure 214 previously described are shown in FIG. 4 as heaters 400 and impingement structures 402. The impingement structures 402 define between them a plurality of apertures (e.g., holes, channels, openings, etc.). The exhaust gas is free to traverse through these apertures but are guided by the impingement structures 402. In this way, the impingement structures 402 may, for example, function as a flow straightener such that the flow of the exhaust gas is straightened prior to flowing from the decomposition reactor 202.

Each of the impingement structures 402 has one of the heaters 400 incorporated therein (e.g., on a trailing edge of the impingement structure 402, on an upstream edge of the impingement structure 402, etc.) and functioning to heat the associated impingement structure 402. This arrangement may facilitate rapid heating of the impingement structures 402 because the heaters 400 are dispersed and localized.

In various embodiments, the heaters 400 are electric heaters (e.g., resistance heaters, heating elements, etc.) and not burners (e.g., combustion heaters, etc.). As a result, the heaters 400 themselves do not have any direct emissions (e.g., of combustion byproducts, etc.) into the exhaust gas.

The heaters 400 are connected to a power source (e.g., an electrical system of an internal combustion engine associated with the exhaust gas aftertreatment system 200, etc.) via wires (e.g., electrical wires, etc.). The wires are routed from outside of the decomposition reactor 202 into the decomposition reactor 202 and to the heater 400. In some embodiments, the wires are routed through the decomposition reactor 202 at a location proximate the heaters 400 and through the impingement structures 402 to the heaters 400.

In various embodiments, the decomposition reactor 202 includes a swirl mixer 404 (e.g., mixing plate, vane mixer, co-swirl mixer, counter-swirl mixer, etc.) that is coupled to the body 203. The swirl mixer 404 is positioned downstream of the impingement structures 402 and upstream of the outlet 206. The swirl mixer 404 is configured to facilitate mixing between the exhaust gas flowing across and between the impingement structures 402. The swirl mixer 404 may be configured such that the decomposition reactor 202 has a target backpressure and a target mixing length such that the decomposition reactor 202 is tailored for a target application. In other embodiments, the decomposition reactor 202 does not include the swirl mixer 404.

Figure 5:
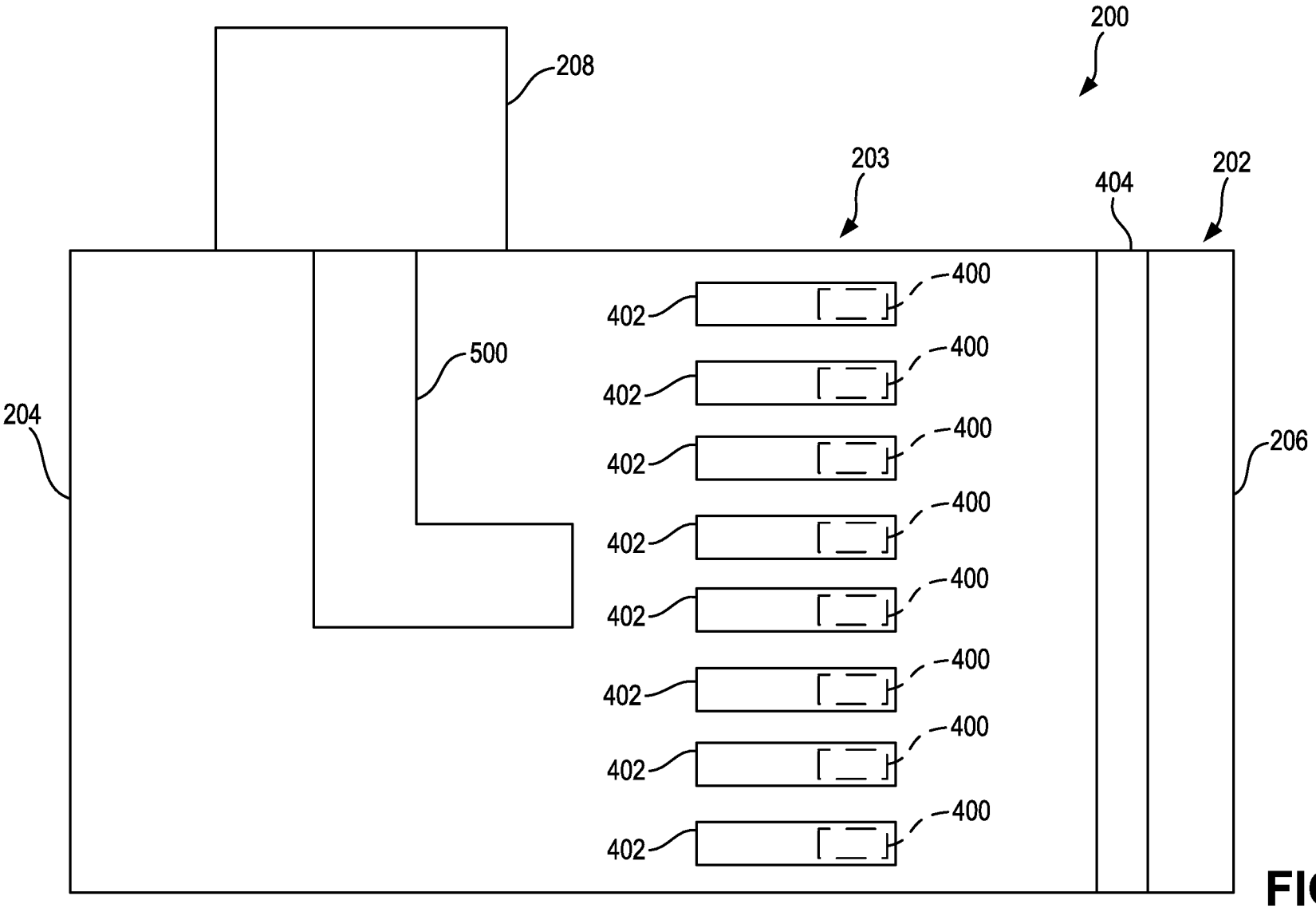
FIG. 5 is a cross-sectional view of the example decomposition reactor shown in FIG. 4 according to another embodiment.

FIG. 5 illustrates the decomposition reactor 202 in another example embodiment. The heater 212 and the impingement structure 214 previously described are shown in FIG. 5 as the heaters 400 and the impingement structures 402 while the injector 210 is shown as an injector 500. The injector 500 extends into the decomposition reactor 202 such that reductant is sprayed from the injector 500 proximate a central axis (e.g., centerline, etc.) of the decomposition reactor 202. In various embodiments, the injector 500 is a dosing lance.

Figure 6:
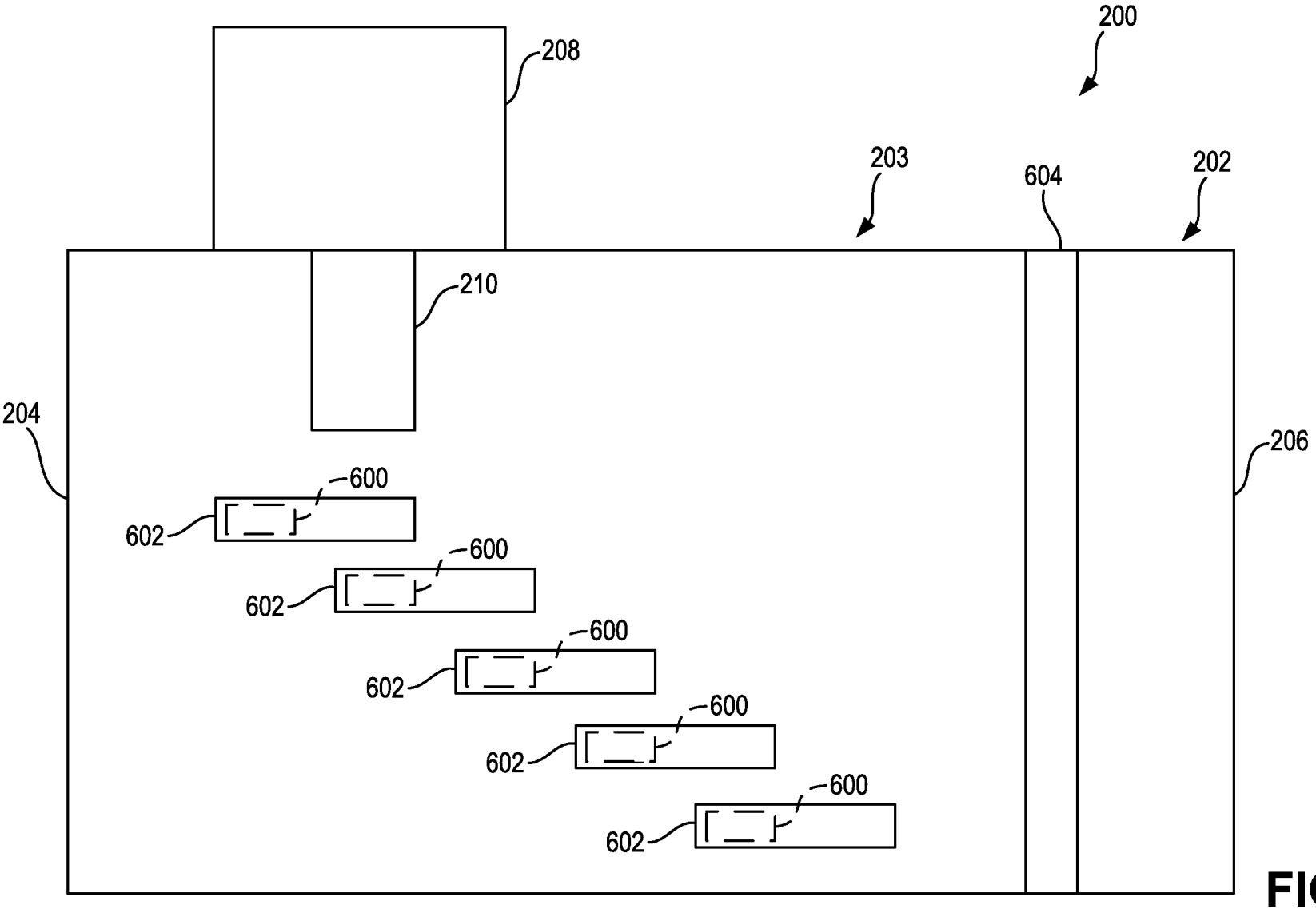
FIG. 6 is a cross-sectional view of an example decomposition reactor of an example exhaust gas aftertreatment system.

FIG. 6 illustrates the decomposition reactor 202 in yet another example embodiment. The heater 212 and the impingement structure 214 previously described are shown in FIG. 6 as heaters 600 and impingement structures 602. The impingement structures 602 define between them a plurality of apertures (e.g., holes, channels, openings, etc.). The exhaust gas is free to traverse through these apertures but are guided by the impingement structures 602. In this way, the impingement structures 602 may, for example, function as a flow straightener such that the flow of the exhaust gas is straightened prior to flowing from the decomposition reactor 202.

Each of the impingement structures 602 has one of the heaters 600 incorporated therein (e.g., on a leading edge of the impingement structure 602, on an upstream edge of the impingement structure 602, etc.) and functioning to heat the associated impingement structure 602. This arrangement may facilitate rapid heating of the impingement structures 602 because the heaters 600 are dispersed and localized. Additionally, the impingement structures 602 are staggered and arranged underneath the injector 210. This arrangement substantially prevents reductant from being sprayed by the injector 210 directly onto the body 203, thereby minimizing deposit formation on the body 203. Instead, the reductant flows towards the impingement structures 602 and is either entrained in the exhaust gas or approaches the impingement structures 602 for decomposition or entraining in the exhaust gas.

In some embodiments, the decomposition reactor 202 also includes a swirl mixer 604 that is coupled to the body 203. The swirl mixer 604 functions as the swirl mixer 404 previously described. In other embodiments, the decomposition reactor 202 does not include the swirl mixer 604.

Figure 7:
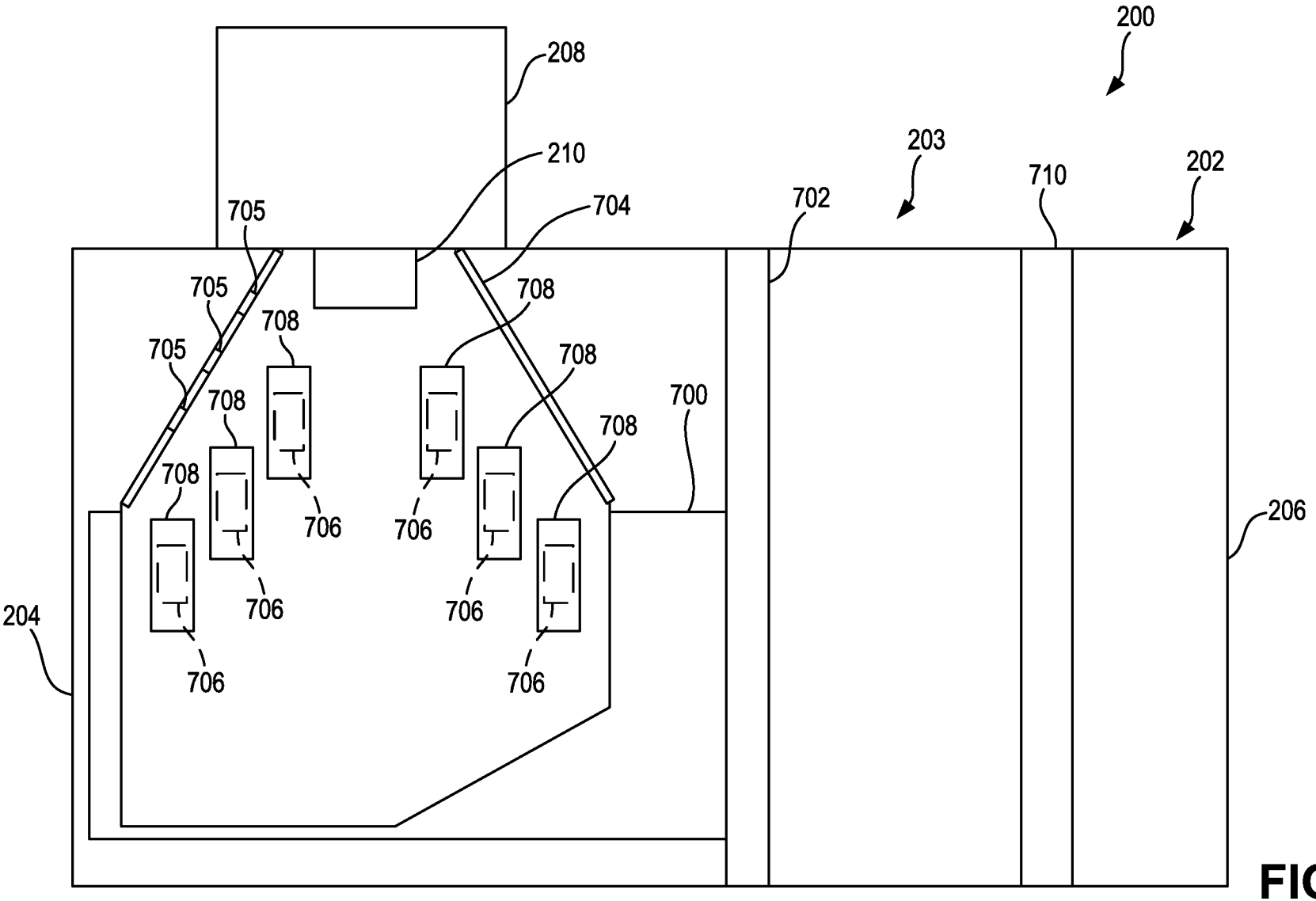
FIG. 7 is a cross-sectional view of an example decomposition reactor of an example exhaust gas aftertreatment system.

FIG. 7 illustrates the decomposition reactor 202 in yet another example embodiment. The decomposition reactor 202 includes an inner tube 700 (e.g., mixer tube, etc.) positioned therein. The inner tube 700 is centered on a center axis that is substantially parallel to a center axis of the decomposition reactor 202. The inner tube 700 is configured to receive the exhaust gas directly from the inlet 204 (e.g., via an aperture in a leading surface of the inner tube 700, etc.) and to provide the exhaust gas to the outlet 206. The inner tube 700 is coupled to the decomposition reactor 202 via a flange 702. The flange 702 may be integral with the inner tube 700 and/or the body 203 and/or may be coupled (e.g., fastened, adhered, welded, etc.) to the inner tube 700 and/or the body 203. In some embodiments, the flange 702 facilitates the passage of the exhaust gas therethrough such that some of the exhaust gas may flow from the inlet 204 to the outlet 206 without flowing through the inner tube 700. In other embodiments, the flange 702 is sealed to the decomposition reactor 202 such that the exhaust gas is prevented from bypassing the inner tube 700 and is only able to flow from the inlet 204 to the outlet 206 via the inner tube 700.

The decomposition reactor 202 also includes a guide 704 (e.g., exhaust assist, shield, cone, etc.). The guide 704 is coupled to the inner tube 700 and positioned around the injector 210. In some embodiments, the guide 704 is coupled to the body 203. In other embodiments, the guide 704 is coupled to the injector 210. The guide 704 is configured to receive reductant from the injector 210 and to provide the reductant into the inner tube 700. The guide 704 includes a plurality of guide apertures 705 (e.g., holes, openings, etc.) that are configured to receive the exhaust gas such that the received exhaust gas is utilized to drive the reductant from the injector 210 into the inner tube 700. The guide apertures 705 may be disposed, for example, on an upstream face of the guide 704.

The heater 212 and the impingement structure 214 previously described are shown in FIG. 7 as heaters 706 and impingement structures 708. The impingement structures 708 are at least partially disposed within the guide 704 such that the exhaust gas and reductant are directed through the impingement structures 708 as the exhaust gas and the reductant are being driven into the inner tube 700. The impingement structures 708 may be arranged so as to impart a swirl on the exhaust gas and the reductant in order to facilitate mixing of the exhaust gas and the reductant.

Each of the impingement structures 708 has one of the heaters 706 incorporated therein (e.g., on a middle portion of the impingement structure 708, etc.) and functioning to heat the associated impingement structure 708. This arrangement may facilitate rapid heating of the impingement structures 708 because the heaters 706 are dispersed and localized. Additionally, the impingement structures 708 are staggered and arranged underneath the injector 210. This arrangement substantially prevents reductant from being sprayed by the injector 210 directly onto the inner tube 700 or guide 704, thereby minimizing deposit formation on the inner tube 700 and/or the guide 704. Instead, the reductant flows towards the impingement structures 708 and is either entrained in exhaust gas or approaches the impingement structures 708 for decomposition or entraining in the exhaust gas.

The guide apertures 705 may be configured such that a target amount of exhaust gas is received by the guide 704, the target amount being a minimum amount of exhaust gas necessary to drive the reductant from the injector 210 into the inner tube 700. By using only the minimum amount of exhaust gas to drive the reductant into the inner tube 700, only a minimum amount of heating by the heaters 706 is necessary, thereby decreasing the power consumption of the heaters 706 and making the exhaust gas aftertreatment system 200 more desirable.

The heaters 706 are connected to a power source (e.g., an electrical system of an internal combustion engine associated with the exhaust gas aftertreatment system 200, etc.) via wires (e.g., electrical wires, etc.). The wires are routed from outside of the decomposition reactor 202 into the decomposition reactor 202 and to the heaters 706. In some embodiments, the wires are routed through the decomposition reactor 202 at a location proximate the guide 704, along a downstream face of the guide 704, through the guide 704, and through the impingement structures 708 to the heaters 706.

In some embodiments, the decomposition reactor 202 also includes a swirl mixer 710 that is coupled to the body 203. The swirl mixer 710 functions as the swirl mixer 404 previously described. In other embodiments, the decomposition reactor 202 does not include the swirl mixer 710.

Figure 8:
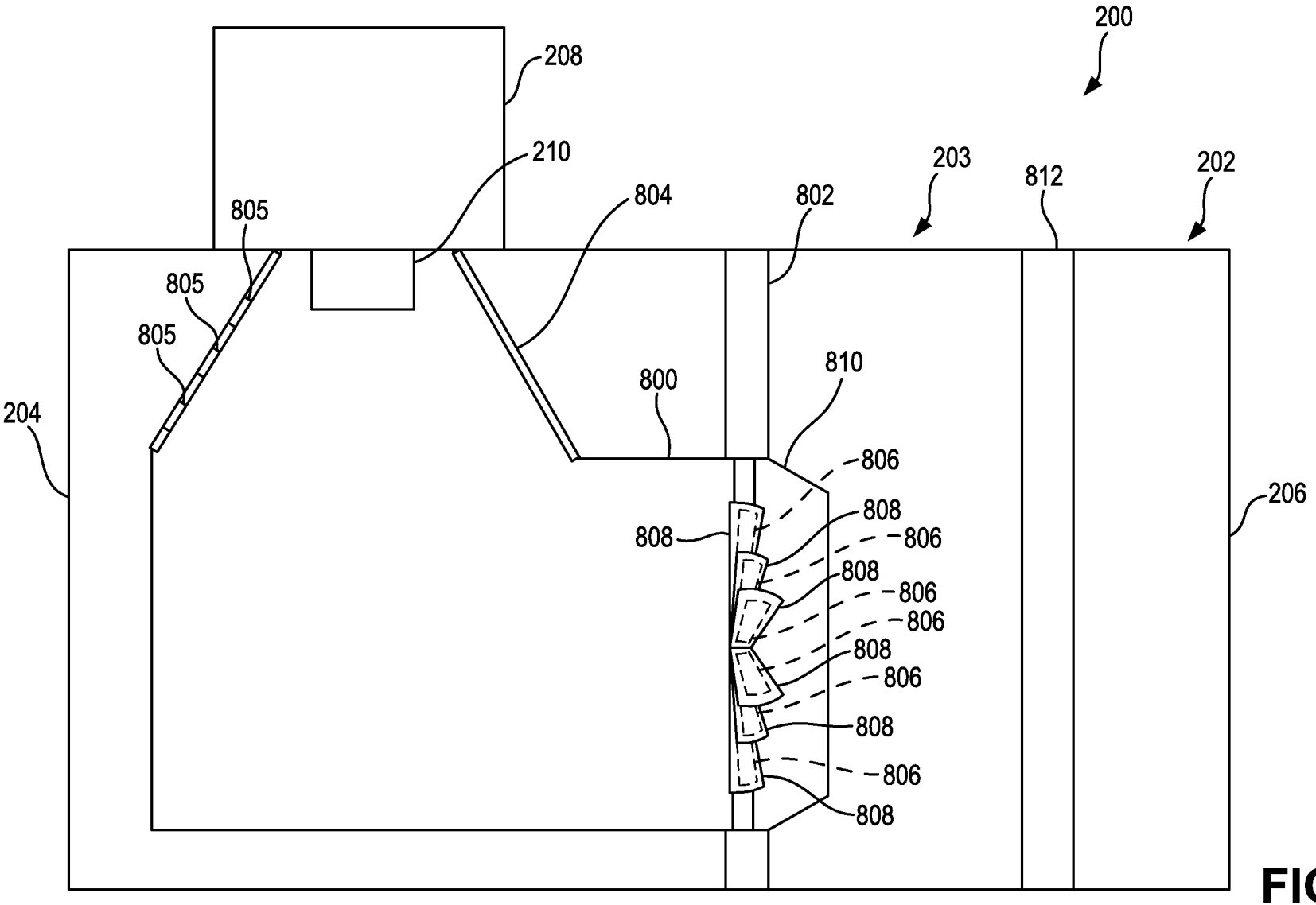
FIG. 8 is a cross-sectional view of an example decomposition reactor of an example exhaust gas aftertreatment system.

FIG. 8 illustrates the decomposition reactor 202 in yet another example embodiment. The inner tube 700, the flange 702, the guide 704, the guide apertures 705, the heater 212, and the impingement structure 214 previously described are shown in FIG. 8 as an inner tube 800, a flange 802, a guide 804, guide apertures 805, a heater 806, and impingement structures 808. The inner tube 800 includes a downstream end 810. The downstream end 810 provides a flow constriction for the exhaust gas flowing from the inner tube 800 into the decomposition reactor 202.

The impingement structures 808 are at least partially disposed within the downstream end 810 such that the exhaust gas and reductant are directed through the impingement structures 808 as the exhaust gas and the reductant are being driven out of the inner tube 800. The impingement structures 808 define between them a plurality of apertures (e.g., holes, channels, openings, etc.). The exhaust gas is free to traverse through these apertures but is guided by the impingement structures 808. In this way, the impingement structures 808 may, for example, be arranged so as to impart a swirl on the exhaust gas and the reductant in order to facilitate mixing of the exhaust gas and the reductant. In other applications, the impingement structures 808 may function as a flow straightener such that the flow of the exhaust gas is straightened prior to flowing from the decomposition reactor 202.

Each of the impingement structures 808 has a portion of the heater 806 incorporated therein (e.g., in a middle portion of each of the impingement structures 808, etc.). The heater 806 is a continuous element that extends in a spiral manner within the inner tube 800 and/or the downstream end 810 such that the heater 806 is capable of being incorporated within each of the impingement structures 808. In this way, the heater 806 may function to heat all of the impingement structures 808 simultaneously. This arrangement substantially prevents reductant from forming deposits on the impingement structures 808. Instead, the reductant is mixed with the exhaust gas by the impingement structures 808.

The guide apertures 805 may be configured such that a target amount of exhaust gas is received by the guide 804, the target amount being a minimum amount of exhaust gas necessary to drive the reductant from the injector 210 into the inner tube 800. By using only the minimum amount of exhaust gas to drive the reductant into the inner tube 800, only a minimum amount of heating by the heaters 806 is necessary, thereby decreasing the power consumption of the heaters 806 and making the exhaust gas aftertreatment system 200 more desirable.

The heaters 806 are connected to a power source (e.g., an electrical system of an internal combustion engine associated with the exhaust gas aftertreatment system 200, etc.) via wires (e.g., electrical wires, etc.). The wires are routed from outside of the decomposition reactor 202 into the decomposition reactor 202 and to the heaters 806. In some embodiments, the wires are routed through the decomposition reactor 202 at a location proximate the guide 804, along a downstream face of the guide 804, along a top surface of the inner tube 800, through the inner tube 800, and through the impingement structures 808 to the heaters 806.

In some embodiments, the decomposition reactor 202 also includes a swirl mixer 812 that is coupled to the body 203. The swirl mixer 812 functions as the swirl mixer 404 previously described. In other embodiments, the decomposition reactor 202 does not include the swirl mixer 812.

Figure 9:
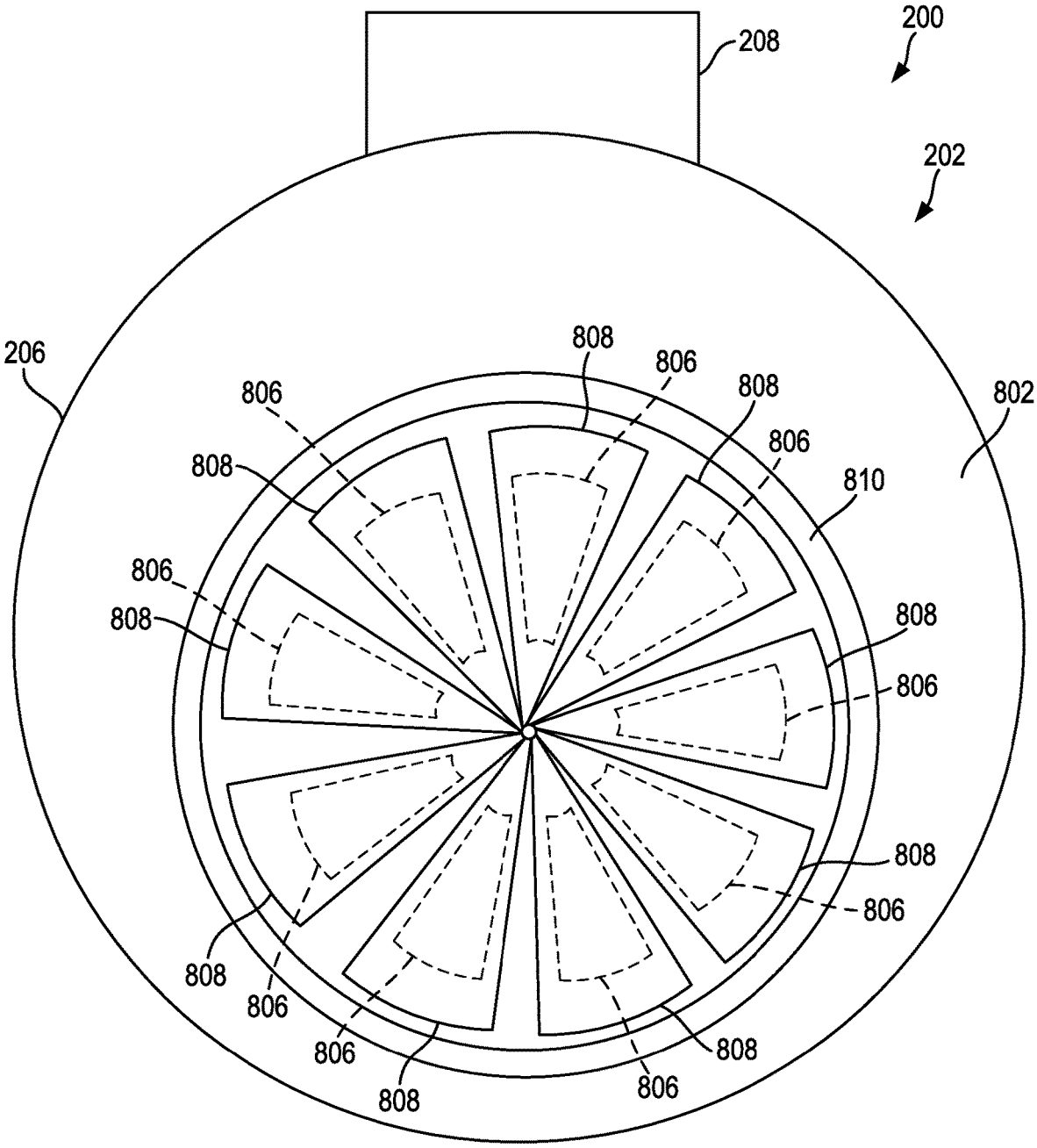
FIG. 9 is a rear view of the decomposition reactor shown in FIG. 8 according to an embodiment.

FIG. 9 illustrates a rear view of the decomposition reactor 202, according to the embodiment shown in FIG. 8, from the outlet 206 towards the inlet 204 and without the swirl mixer 812 shown. As shown in FIG. 9, the impingement structures 808 are coupled to the heater 806 and arranged in a spiral about a center axis of the inner tube 800. In FIG. 9, the heater 806 is shown coupled to each of the impingement structures 808 proximate a downstream end of the impingement structures, rather than the middle portion described in FIG. 8. As shown in FIG. 9, the heater 806, because it is continuously coupled to each of the impingement structures 808, spans between adjacent impingement structures 808. In addition to the impingement structures 808, the heater 806 is configured to facilitate reductant dispersal via the Leidenfrost effect, as described with respect to the impingement structures 808, such that these spanning portions of the heater 806 aid the impingement structures 808 in mitigating or substantially preventing deposit formation in the decomposition reactor 202.

In other embodiments, the heater 806 may instead be replaced with multiple separate heaters, each localized to one impingement structure 808. In still other embodiments, the heater 806 may be replaced with multiple separate heaters, each coupled to two or more impingement structures 808. For example, the decomposition reactor 202 may include two heaters 806, each coupled to half of the impingement structures 808. The heater 806 may be arranged in one or more spirals, helixes (e.g., a double helix, etc.), and other similar shapes. It is understood that the description of the heater 806, the heaters 706, and any other heater disposed at least partially within the inner tube 700, similarly applies to some embodiments of the heaters 600, the heaters 400, and other heaters utilized without the inner tube 700. It is also understood that the description of the heaters 600, the heaters 400, and other heaters utilized without the inner tube 700 similarly applies to some embodiments of the heater 806, the heaters 706, and any other heater disposed at least partially within the inner tube 700.

In various embodiments, the decomposition reactor 202 is configured to minimize heat transfer therethrough such that the additional heat provided by the heaters (e.g., the heaters 400, the heaters 600, the heaters 706, the heater 806, etc.) is retained by the decomposition reactor 202, thereby provided the exhaust and reductant to downstream component of the exhaust gas aftertreatment system 200, such as a SCR catalyst, with the additional heat provided by the heaters.

This additional heat may facilitate attainment of higher efficiencies by the exhaust gas aftertreatment system 200. The decomposition reactor 202 may be configured to minimize heat transfer via wrapping of insulation around the decomposition reactor 202 as well as constructing the decomposition reactor 202 utilizing different materials (e.g., materials with lower coefficients of thermal conductivity, etc.).

Figure 10:
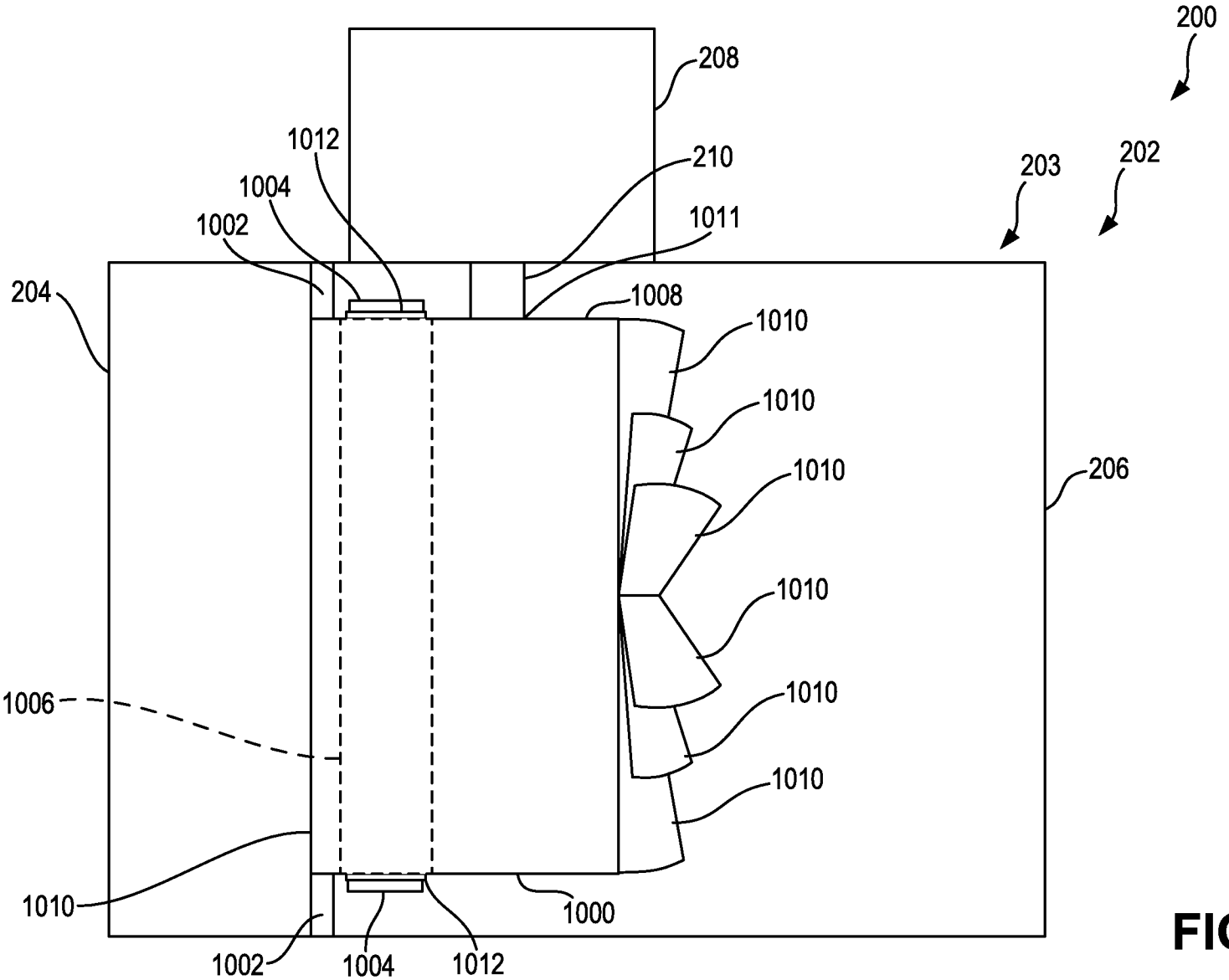
FIG. 10 is a cross-sectional view of an example decomposition reactor of an example exhaust gas aftertreatment system.
Figure 11:
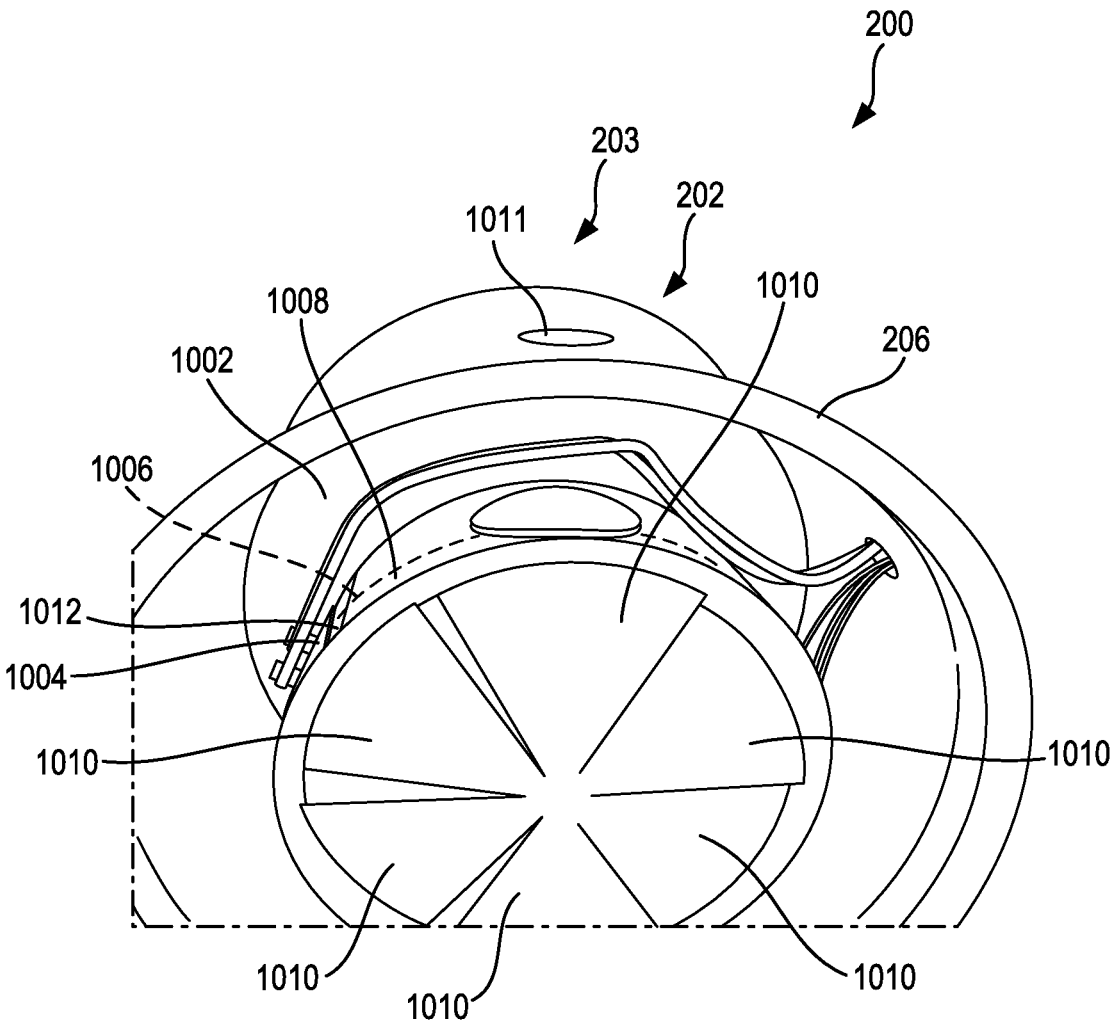
FIG. 11 is a rear view of the decomposition reactor shown in FIG. 10 according to an embodiment.

FIGS. 10 and 11 illustrate the decomposition reactor 202 in yet another example embodiment. The inner tube 700, the flange 702, the heater 212, and the impingement structure 214 previously described are shown in FIGS. 10 and 11 as an inner tube 1000, a flange 1002, a heater 1004, and an impingement structure 1006. As shown in FIGS. 10 and 11, the decomposition reactor 202 does not include a guide (e.g., a guide similar to the guide 704, etc.) or guide apertures (e.g., similar to the guide apertures 705, etc.). However, it is understood that the decomposition reactor 202 as shown in FIGS. 10 and 11 may include a guide and guide apertures in some embodiments.

The inner tube 1000 includes a downstream end 1008. The inner tube 1000 includes a plurality of vanes 1010. Each of the vanes 1010 is at least partially disposed within the downstream end 1008 such that the exhaust gas and reductant are directed through the vanes 1010 as the exhaust gas and the reductant are being driven out of the inner tube 1000. The vanes 1010 define between them a plurality of apertures (e.g., holes, channels, openings, etc.). The exhaust gas is free to traverse through these apertures but is guided by the vanes 1010. In this way, the vanes 1010 may, for example, be arranged so as to impart a swirl on the exhaust gas and the reductant in order to facilitate mixing of the exhaust gas and the reductant. In other applications, the vanes 1010 may function as a flow straightener such that the flow of the exhaust gas is straightened prior to flowing from the decomposition reactor 202.

Rather than being the vanes 1010, the impingement structure 1006 is a portion of the inner tube 1000 (e.g., a wall segment of the inner tube 1000, etc.). The impingement structure 1006 is disposed proximate an upstream end 1010 of the inner tube 1000. The upstream end 1010 is opposite the downstream end 1008.

The impingement structure 1006 extends around the inner tube 1000. In various embodiments, the impingement structure 1006 extends along more than half of a circumference of the inner tube 1000. For example, in some embodiments, the impingement structure 1006 extends along 75% of the circumference of the inner tube 1000. In some embodiments, the impingement structure 1006 extends around at least the entire circumference of the inner tube 1000.

The impingement structures 1006 is located at least partially opposite from an injector aperture 1011 that is configured to receive the injector 210. For example, the injector aperture 1011 may be disposed in a top portion of the inner tube 1000 and the impingement structure 1006 may extend around a bottom portion of the inner tube 1000 (e.g., opposite the top portion of the inner tube 1000).

The exhaust gas aftertreatment system 200 also includes a distribution plate 1012. The distribution plate 1012 is coupled to the impingement structure 1006 and the heater 1004. As a result, the distribution plate 1012 and the heater 1004 extend at least partially around the inner tube 1000. The heater 1004 is coupled to the distribution plate 1012. In some embodiments, the heater 1004 is coupled to both the distribution plate 1012 and the impingement structure 1006. The distribution plate 1012 extends at least partially between the heater 1004 and the impingement structure 1006. This arrangement substantially prevents reductant sprayed by the injector 210 from forming deposits on the impingement structure 1006.

The distribution plate 1012 absorbs the heat provided by the heater 1004 and functions to increase uniformity of the heat provided to the impingement structure 1006 by the heater 1004. For example, the distribution plate 1012 may smooth out a discontinuity of the heat provided by different heating elements (e.g., wires, plates, etc.) within the heater 1004 by spanning across the different heating elements, absorbing the heat provided by the different heating elements, and distributing that heat throughout the distribution plate 1012 (e.g., across a portion of the distribution plate 1012 that extends between the different heating elements, etc.). In various embodiments, the distribution plate 1012 is constructed from a material with a higher thermal conductivity than a thermal conductivity of the impingement structure 1006. In some embodiments, the distribution plate 1012 is constructed from copper. In one embodiment, the heater 1004 is a 2500 Watt (W) heater. The heater 1004 may be defined by a maximum operating temperature (e.g., a temperature above which the heater 1004 is unable to operate desirably, etc.). In some embodiments, the heater 1004 is defined by a maximum operating temperature of 760 degrees Celsius (° C.).

In addition to the impingement structure 1006, the heater 1004 is configured to facilitate reductant dispersal via the Leidenfrost effect, as described with respect to the impingement structure 1006 such that spanning portions of the heater 1004 aid the impingement structure 1006 in mitigating or substantially preventing deposit formation in the decomposition reactor 202.

The heater 1004 is connected to a power source (e.g., an electrical system of an internal combustion engine associated with the exhaust gas aftertreatment system 200, etc.) via wires (e.g., electrical wires, etc.). The wires are routed from outside of the decomposition reactor 202 into the decomposition reactor 202 and to the heater 1004.

The heat $\Delta$ that must be provided by the heater 1004 to maintain a particular surface temperature $\sigma$ of the impingement structure 1006 may be modeled according to various equations. These equations are derived by comparing the $\sigma$ at various times between the moment reductant is provided by the injector 210 and one second after the moment reductant is provided by the injector 210 (e.g., at the moment reductant is provided by the injector 210, at 0.5 seconds after the moment reductant is provided by the injector 210, and at 1 second after the moment reductant is provided by the injector 210, etc.). The equations do not consider a distance between the injector 210 (e.g., a tip of the injector) and the impingement structure 1006, do not consider spray characteristics of the reductant provided by the injector 210, do not consider heat loss from the heater 1004 to the exhaust gas, and assume that all reductant impinges on the impingement structure 1006. These equations depend on the thickness of the impingement structure 1006, the area of the impingement structure 1006, the initial temperature of the reductant provided by the injector 210, and a diameter of the inner tube 1000. For an impingement structure 1006 that is steel, has a thickness of 1.39 millimeters (mm), an area of 645.16 $mm^2$, reductant with an initial temperature of 25° C., and an inner tube 1000 with a diameter of 266.7 mm, the $\Delta$, in kilowatts (kW) is, for a $\sigma$ in ° C., $$\Delta=0.04425\sigma-15.26kW \quad (1)$$

or $$\Delta=0.044\sigma-10.85kW \quad (2)$$

or $$\Delta=0.0434\sigma-6.86kW \quad (3)$$

FIG. 11 illustrates a rear view of the decomposition reactor 202, according to the embodiment shown in FIG. 10, from the outlet 206 towards the inlet 204 and without the injector 210 shown.

In other embodiments, the heater 1004 may instead be replaced with multiple separate heaters, each localized to one portion of the impingement structure 1006. For example, the decomposition reactor 202 may include two heaters 1004, each coupled to half of the impingement structure 1006. The heater 1004 may be arranged in one or more spirals, helixes (e.g., a double helix, etc.), and other similar shapes. It is understood that the description of the heater 1004, the heater 806, the heaters 706, and any other heater disposed at least partially within or around an inner tube, similarly applies to some embodiments of the heaters 600, the heaters 400, and other heaters utilized without the inner tube 700. It is also understood that the description of the heaters 600, the heaters 400, and other heaters utilized without the inner tube 700 similarly applies to some embodiments of the heater 1004, the heater 806, the heaters 706, and any other heater disposed at least partially within or around an inner tube.

In various embodiments, the decomposition reactor 202 is configured to minimize heat transfer therethrough such that the additional heat provided by the heaters (e.g., the heaters 400, the heaters 600, the heaters 706, the heater 806, the heater 1004, etc.) is retained by the decomposition reactor 202, thereby provided the exhaust and reductant to downstream component of the exhaust gas aftertreatment system 200, such as a SCR catalyst, with the additional heat provided by the heaters. This additional heat may facilitate attainment of higher efficiencies by the exhaust gas aftertreatment system 200. The decomposition reactor 202 may be configured to minimize heat transfer via wrapping of insulation around the decomposition reactor 202 as well as constructing the decomposition reactor 202 utilizing different materials (e.g., materials with lower coefficients of thermal conductivity, etc.).

FIGS. 12-15 illustrate the decomposition reactor 202 in yet another example embodiment. The inner tube 700, the heater 212, and the impingement structure 214 previously described are shown in FIGS. 12-15 as an inner tube 1200, a plurality of heaters 1202, and an impingement structure 1204. As shown in FIGS. 12-15, the decomposition reactor 202 does not include a guide (e.g., a guide similar to the guide 704, etc.), guide apertures (e.g., similar to the guide apertures 705, etc.), or vanes (e.g., similar to the vanes 1010, etc.). However, it is understood that the decomposition reactor 202 as shown in FIGS. 12-15 may include a guide, guide apertures, and/or vanes in some embodiments.

The inner tube 1200 includes a downstream end 1206 and an upstream end 1208 opposite the downstream end 1206. The impingement structure 1204 is disposed proximate the upstream end 1208 (e.g., the impingement structure 1204 is located closer to the upstream end 1208 than the downstream end 1206).

The exhaust gas aftertreatment system 200 also includes a mixing plate 1209. The mixing plate 1209 is disposed within, and coupled to, the inner tube 1000. In this way, the mixing plate 1209 extends across the inner tube 1000. The mixing plate 1209 is located between the impingement structure 1204 and the downstream end 1206. In various embodiments, the mixing plate 1209 is located proximate the downstream end 1206 (e.g., the mixing plate 1209 is closer to the downstream end 1206 than the upstream end 1208).

The mixing plate 1209 includes a plurality of mixing plate apertures 1210 and a mixing plate channel 1212. The exhaust gas may flow through the mixing plate 1209 via one of the mixing plate apertures 1210. Additionally, the exhaust gas may be directed by the mixing plate to the mixing plate channel 1212, and may flow through the mixing plate 1209 via the mixing plate channel 1212. The mixing plate channel 1212 is configured to cause the exhaust gas exiting the mixing plate channel 1212 to swirl downstream of the mixing plate 1209. The mixing plate apertures 1210 are configured to reduce a backpressure of the exhaust gas aftertreatment system 200 by enabling some of the exhaust gas to bypass the mixing plate channel 1212.

Rather than being the mixing plate 1209, the impingement structure 1204 is a portion of the inner tube 1200 (e.g., a wall segment of the inner tube 1200, etc.). The impingement structure 1204 extends around the inner tube 1200. In various embodiments, the impingement structure 1204 extends approximately half of a circumference of the inner tube 1200.

The impingement structures 1204 is located at least partially opposite from an injector aperture 1211 that is configured to receive the injector 210. For example, the injector aperture 1211 may be disposed in a top portion of the inner tube 1200 and the impingement structure 1204 may extend around a bottom portion of the inner tube 1200 (e.g., opposite the top portion of the inner tube 1200).

The exhaust gas aftertreatment system 200 also includes a distribution plate 1214. The distribution plate 1214 is coupled to the impingement structure 1204 and the heaters 1202. As a result, the distribution plate 1214 and the heaters 1202 extend at least partially around the inner tube 1200. The heaters 1202 are each coupled to the distribution plate 1214. In some embodiments, the heaters 1202 are each coupled to both the distribution plate 1214 and the impingement structure 1204. The distribution plate 1214 extends at least partially between the heaters 1202 and the impingement structure 1204. This arrangement substantially prevents reductant sprayed by the injector 210 from forming deposits on the impingement structure 1204.

The distribution plate 1214 absorbs the heat provided by the heaters 1202 and functions to increase uniformity of the heat provided to the impingement structure 1204 by the heaters 1202. For example, the distribution plate 1214 may smooth out a discontinuity of the heat provided by different heaters 1202 by spanning across the different heaters 1202, absorbing the heat provided by the different heaters 1202, and distributing that heat throughout the distribution plate 1214 (e.g., across a portion of the distribution plate 1214 that extends between the different heaters 1202, etc.). In various embodiments, the distribution plate 1214 is constructed from a material with a higher thermal conductivity than a thermal conductivity of the impingement structure 1204.

In addition to the impingement structure 1204, the heaters 1202 are configured to facilitate reductant dispersal via the Leidenfrost effect, as described with respect to the impingement structure 1204, such that spanning portions of the heaters 1202 aid the impingement structure 1204 in mitigating or substantially preventing deposit formation in the decomposition reactor 202.

The heaters 1202 are connected to a power source (e.g., an electrical system of an internal combustion engine associated with the exhaust gas aftertreatment system 200, etc.) via wires (e.g., electrical wires, etc.). The wires are routed from outside of the decomposition reactor 202 into the decomposition reactor 202 and to the heaters 1202.

Figure 12:
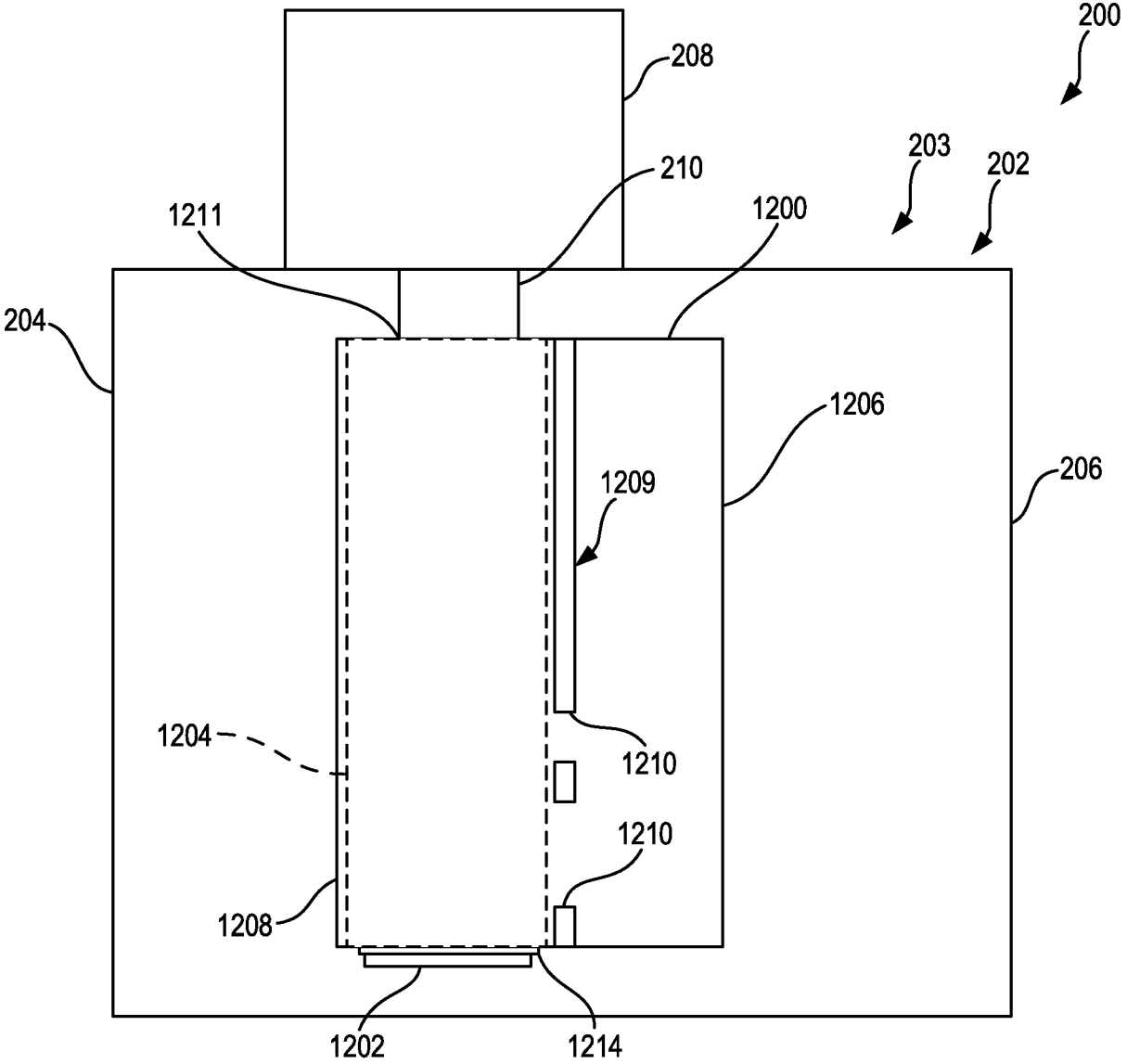
FIG. 12 is a cross-sectional view of an example decomposition reactor of an example exhaust gas aftertreatment system.
Figure 13:
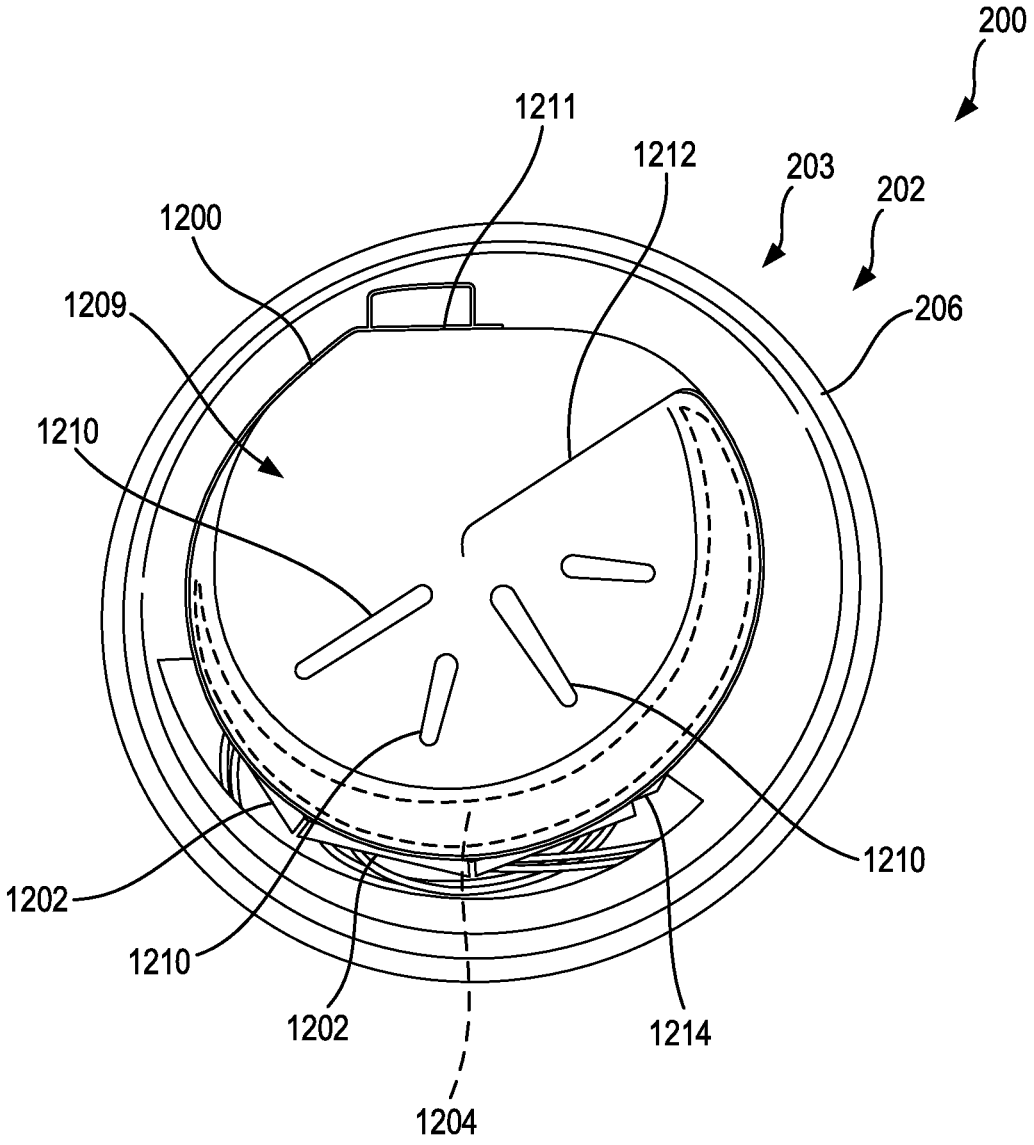
FIG. 13 is a front view of the decomposition reactor shown in FIG. 12 according to an embodiment.
Figure 14:
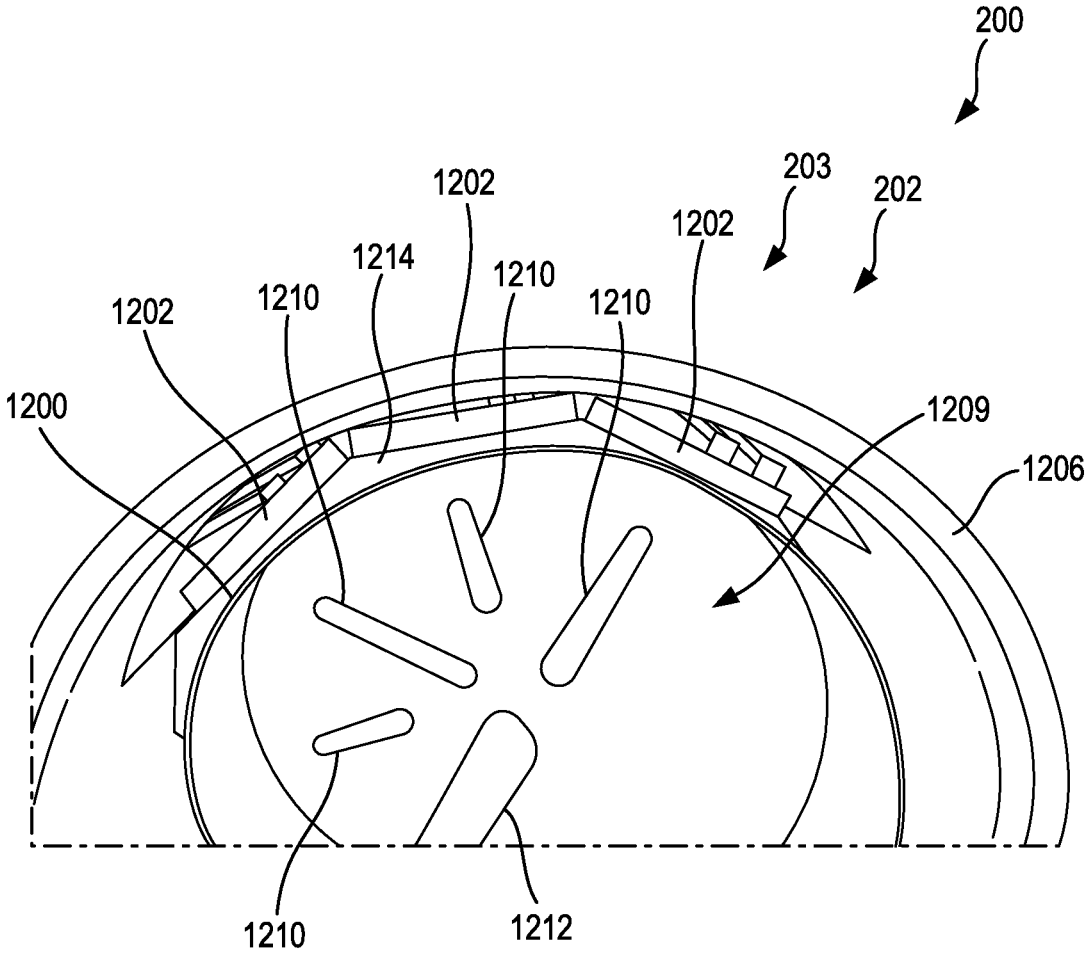
FIG. 14 is a rear view of the decomposition reactor shown in FIG. 12 according to an embodiment.
Figure 15:
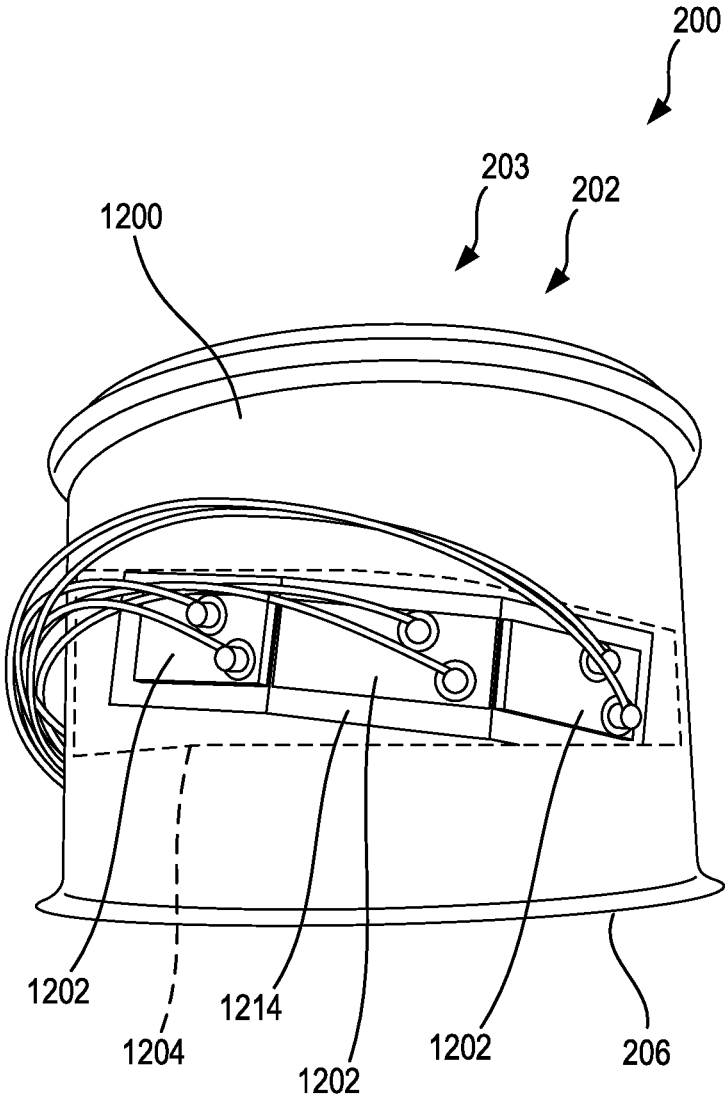
FIG. 15 is a top view of an inner tube of the decomposition reactor shown in FIG. 12 according to an embodiment.

FIG. 13 illustrates a front view of the decomposition reactor 202, according to the embodiment shown in FIG. 12, from the inlet 204 towards the outlet 206. FIG. 14 illustrates a rear view of the decomposition reactor 202, according to the embodiment shown in FIG. 12, from the outlet 206 towards the inlet 204. As shown in FIG. 14, the heaters 1202 are arranged in a spiral about a center axis of the inner tube 1200. As shown in FIG. 14, the distribution plate 1214, because it is continuously coupled to each of the heaters 1202, spans between adjacent heaters 1202. In addition to the impingement structures 1204, the heaters 1202 are configured to facilitate reductant dispersal via the Leidenfrost effect such that these spanning portions of the distribution plate 1214 aid the impingement structures 1204 in mitigating or substantially preventing deposit formation in the decomposition reactor 202. FIG. 15 illustrates the inner tube 1200 removed from the decomposition reactor 202.

In other embodiments, the heaters 1202 may instead be replaced with a single heater 1202. The heaters 1202 may be arranged in one or more spirals, helixes (e.g., a double helix, etc.), and other similar shapes. It is understood that the description of the heaters 1202, the heater 1004, the heater 806, the heaters 706, and any other heater disposed at least partially within or around an inner tube, similarly applies to some embodiments of the heaters 600, the heaters 400, and other heaters utilized without the inner tube 700. It is also understood that the description of the heaters 600, the heaters 400, and other heaters utilized without the inner tube 700 similarly applies to some embodiments of the heaters 1202, the heater 1004, the heater 806, the heaters 706, and any other heater disposed at least partially within or around an inner tube.

In various embodiments, the decomposition reactor 202 is configured to minimize heat transfer therethrough such that the additional heat provided by the heaters (e.g., the heaters 400, the heaters 600, the heaters 706, the heater 806, the heater 1004, the heaters 1202 etc.) is retained by the decomposition reactor 202, thereby provided the exhaust and reductant to downstream component of the exhaust gas aftertreatment system 200, such as a SCR catalyst, with the additional heat provided by the heaters. This additional heat may facilitate attainment of higher efficiencies by the exhaust gas aftertreatment system 200. The decomposition reactor 202 may be configured to minimize heat transfer via wrapping of insulation around the decomposition reactor 202 as well as constructing the decomposition reactor 202 utilizing different materials (e.g., materials with lower coefficients of thermal conductivity, etc.).

Figure 16:
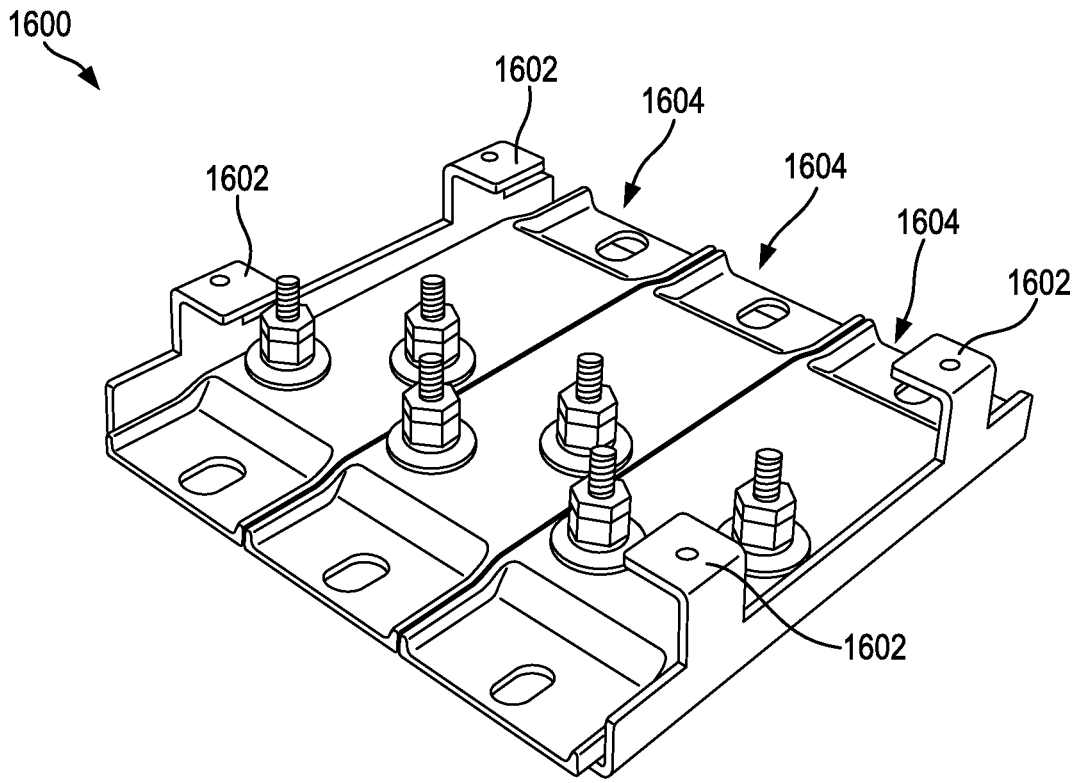
FIG. 16 is a perspective view of an example impingement structure for an exhaust gas aftertreatment system.
Figure 17:
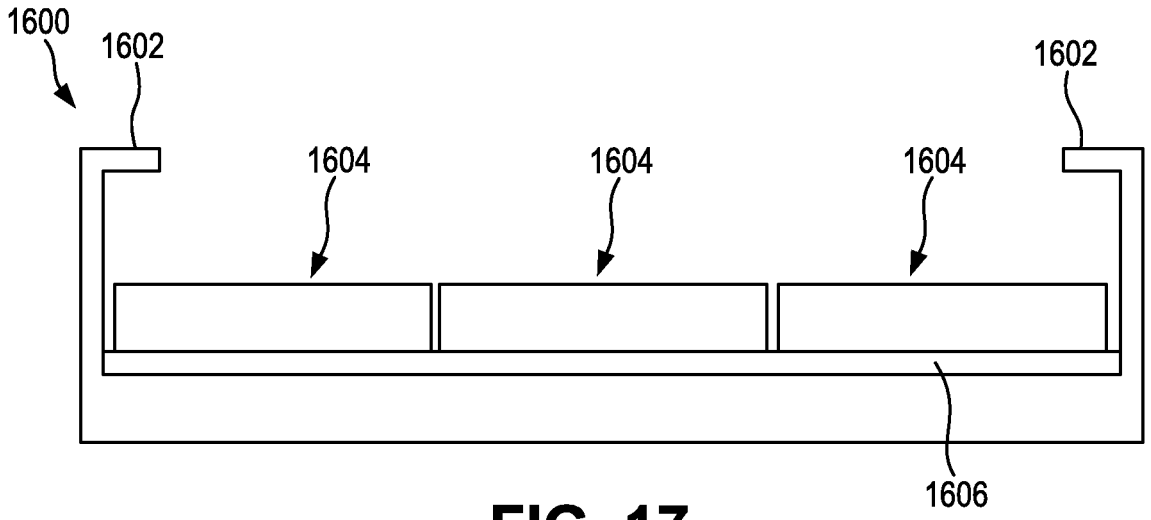
FIG. 17 is a cross-sectional view of the impingement structure shown in FIG. 16 according to an embodiment.

FIGS. 16 and 17 illustrate an impingement structure 1600 for use in the decomposition reactor 202. The impingement structure 1600 may be the impingement structure 214, the impingement structure 402, the impingement structure 602, the impingement structure 708, the impingement structure 808, the impingement structure 1006, or the impingement structure 1204, previously described. In some embodiments, the impingement structure 1600 is constructed from stainless steel. In one embodiment, the impingement structure 1600 is constructed from SS439 stainless steel. The impingement structure 1600 also includes a plurality of legs 1602 (e.g., standoffs, etc.). Each of the legs 1602 is configured to be coupled to a surface or a component of the decomposition reactor 202.

The impingement structure 1600 also includes a plurality of heaters 1604. The heaters 1604 may each function as the heater 212, the heater 400, the heater 600, the heater 706, the heater 806, the heater 1004, or the heater 1202, previously described. The heaters 1604 are coupled to the impingement structure 1600 such that the heaters 1604 are located between the impingement structure 1600 and the component of the exhaust gas aftertreatment system 200 that the legs 1602 are coupled to. In some embodiments, each of the heaters 1604 is a strip heater. In one embodiment, each of the heaters 1604 is a 300 W strip heater.

In some embodiments, the impingement structure 1600 also includes a distribution plate 1606. The distribution plate 1606 extends at least partially between the heaters 1604 and the impingement structure 1600. The distribution plate 1606 absorbs the heat provided by the heaters 1604 and functions to increase uniformity of the heat provided to the impingement structure 1600 by the heaters 1604. For example, the distribution plate 1606 may smooth out a discontinuity of the heat provided between adjacent heaters 1604 by spanning across the heaters 1604, absorbing the heat provided by the heaters 1604, and distributing that heat throughout the distribution plate 1606 (e.g., across a portion of the distribution plate 1606 that extends between the heaters 1604). In various embodiments, the distribution plate 1606 is constructed from a material with a higher thermal conductivity than a thermal conductivity of the impingement structure 1600. In some embodiments, the distribution plate 1606 is constructed from copper.

Figure 18:
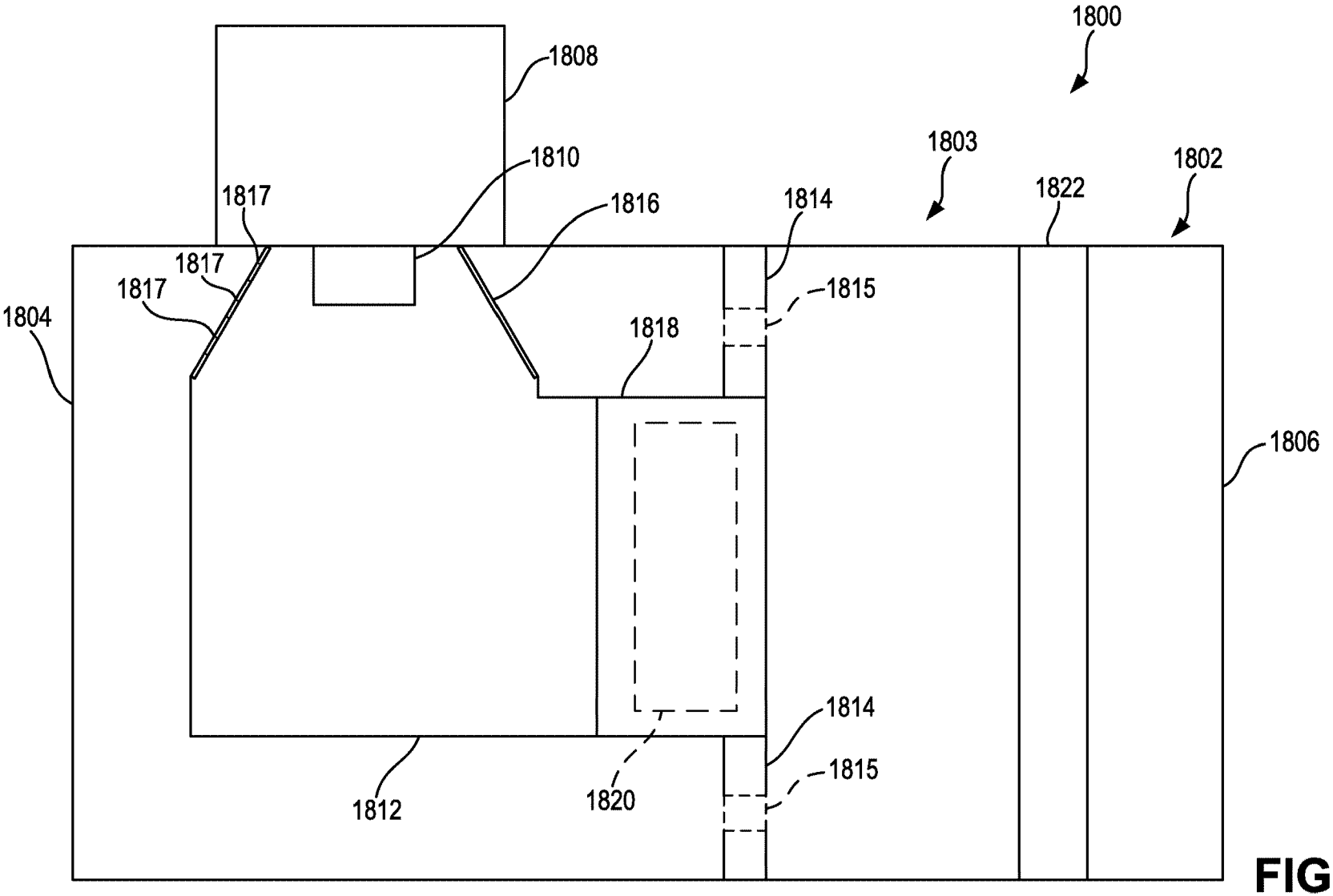
FIG. 18 is a side cross-sectional view of an example decomposition reactor of an example exhaust gas aftertreatment system.

IV. Example Exhaust Gas Aftertreatment System with Heater and Internal Bypass Ammonia Generator FIG. 18 illustrates a cross-sectional view of an example exhaust gas aftertreatment system 1800. The exhaust gas aftertreatment system 1800 may function as the exhaust gas aftertreatment system 100 and/or the exhaust gas aftertreatment system 200 previously described. The exhaust gas aftertreatment system 1800 includes a decomposition reactor 1802. The decomposition reactor 1802 may function as the decomposition chamber 108 and/or the decomposition reactor 202 previously described. The decomposition reactor 1802 includes a body 1803 having an inlet 1804 (e.g., input, entrance, etc.) and an outlet 1806 (e.g., outlet, exit, etc.). The inlet 1804 is configured to receive exhaust gas from an upstream component of the exhaust gas aftertreatment system 1800, such as a DPF similar to the DPF 106 previously described or a DOC. The outlet 1806 is configured to provide a mixture of exhaust gas and reductant (e.g., treated exhaust gas, etc.) to a downstream component of the exhaust gas aftertreatment system 1800, such as a catalyst similar to the SCR catalyst 110 previously described.

The exhaust gas aftertreatment system 1800 also includes a dosing module 1808. The dosing module 1808 may function as the dosing module 114 and/or the dosing module 208 previously described. The dosing module 1808 is configured to receive reductant from a reductant pump, similar to the reductant pump 120, which draws reductant from a reductant supply, similar to the reductant source 118. In some embodiments, the dosing module 1808 also receives air from an air pump, similar to the air pump 128 previously described, which draws air from an air supply, similar to the air source 130.

The dosing module 1808 includes an injector 1810 (e.g., reductant injector, etc.) coupled to the body 1803. The injector 1810 may function as the injector 210 previously described. The injector 1810 is configured to inject reductant from the dosing module 1808 into the decomposition reactor 1802 so that the exhaust gas within the decomposition reactor 1802 can be treated with the reductant. The amount of reductant dosed into the exhaust gas is related to a threshold amount of combustion byproducts that the exhaust gas aftertreatment system 1800 emits into atmosphere. In some applications, the exhaust gas aftertreatment system 1800 is controlled such that the exhaust gas is dosed with a target amount of reductant such that a target amount of combustion byproducts, less than the threshold amount of combustion byproducts, is emitted by the exhaust gas aftertreatment system 1800.

The exhaust gas aftertreatment system 1800 includes an inner tube 1812 (e.g., mixer tube, etc.) positioned therein. The inner tube 1812 may function as the inner tube 700 and/or the inner tube 800 previously described. The inner tube 1812 is centered on a center axis that is substantially parallel to a center axis of body 1803. The inner tube 1812 is configured to receive the exhaust gas directly from the inlet 1804 (e.g., via an aperture in a leading surface of the inner tube 1812, etc.) and to provide the exhaust gas to the outlet 1806. The inner tube 1812 is coupled to the body 1803 via a flange 1814. The flange 1814 may function as the flange 702 and/or the flange 802 previously described. The flange 1814 may be integral with the inner tube 1812 and/or the body 1803 and/or may be coupled (e.g., fastened, adhered, welded, etc.) to the inner tube 1812 and/or the body 1803.

The flange 1814 includes a plurality of flange apertures 1815 (e.g., openings, holes, vents, etc.). Each of the plurality of flange apertures 1815 facilitates the passage of the exhaust gas therethrough such that some of the exhaust gas may flow from the inlet 1804 to the outlet 1806 without flowing through the inner tube 1812.

The decomposition reactor 1802 also includes a guide 1816 (e.g., shield, cone, etc.). The guide 1816 may function as the guide 704 and/or the guide 804 previously described. The guide 1816 is coupled to the inner tube 1812 and positioned around the injector 1810. In some embodiments, the guide 1816 is coupled to the body 1803. In other embodiments, the guide 1816 is coupled to the injector 1810. The guide 1816 is configured to receive reductant from the injector 1810 and to provide the reductant into the inner tube 1812. The guide 1816 includes a plurality of guide apertures 1817 (e.g., holes, openings, etc.) that are configured to receive the exhaust gas such that the received exhaust gas is utilized to drive the reductant from the injector 1810 into the inner tube 1812. The guide apertures 1817 may be disposed, for example, on an upstream face of the guide 1816.

Figure 19:
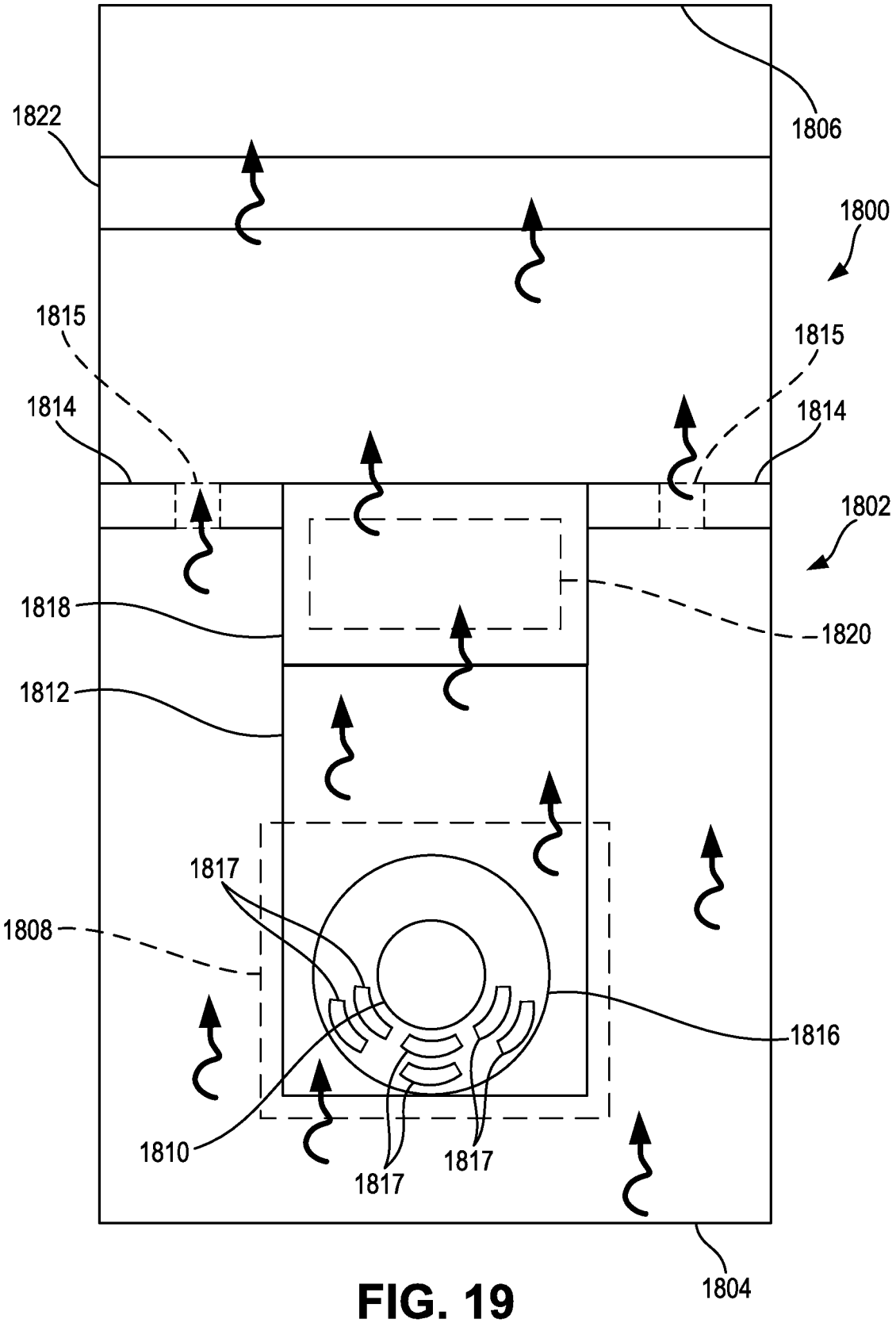
FIG. 19 is a top cross-sectional view of the decomposition reactor shown in FIG. 18.

As shown by the flow arrows in FIG. 19, the exhaust gas flows into the inner tube 1812 either directly (e.g., through an inlet of the inner tube 1812, etc.) or via the guide 1816 (e.g., through apertures in the guide 1816 then from the guide 1816 into the inner tube 1812, etc.) or the exhaust gas does not flow into the inner tube 1812 (e.g., the exhaust gas does not flow into the inlet of the inner tube 1812, the exhaust gas does not flow into the guide 1816 via apertures disposed thereon, etc.) and instead flows through the flange apertures 1815 on the flange 1814. The inner tube 1812, the flange 1814, the flange apertures 1815, and/or the guide 1816 can be configured such that a target amount of the exhaust gas is provided to the temperature controlled catalyst 1818. In some embodiments, the flange apertures 1815 may be selectively varied (e.g., via electrically controlled actuators, via electrically controlled valves, etc.) to provide the target amount of exhaust gas to the temperature controlled catalyst 1818.

The decomposition reactor 1802 includes a temperature controlled catalyst 1818 (e.g., hydrolysis catalyst, etc.). The temperature controlled catalyst 1818 is configured to facilitate hydrolysis of the exhaust gas to generate ammonia using the reductant supplied by the injector 1810. The temperature controlled catalyst 1818 is configured such that the exhaust gas within the inner tube 1812 can only exit the inner tube 1812 (e.g., in route to the outlet 1806, etc.) by first passing through the temperature controlled catalyst 1818.

In some embodiments, the temperature controlled catalyst 1818 may be substantially centered within the body 1803 (e.g., when the center axis of the inner tube 1812 is substantially coincident with the center axis of the body 1803, etc.). In this way, the temperature controlled catalyst 1818 may be coaxially aligned with an SCR catalyst, such as the SCR catalyst 110, downstream of the decomposition reactor 1802. This coaxial alignment may significantly reduce the mixing length of the exhaust gas aftertreatment system 1800.

The temperature controlled catalyst 1818 includes a heater 1820. The heater 1820 is controlled to heat the temperature controlled catalyst 1818 above an activation temperature of the temperature controlled catalyst 1818 such that the temperature controlled catalyst 1818 may catalyze the exhaust gas. This activation temperature may be, for example, approximately 200° C. The heat provided by the heater 1820 aids the temperature controlled catalyst 1818 in performing hydrolysis on the exhaust gas and therefore in producing ammonia.

The temperature controlled catalyst 1818 may be configured to have a minimized heat capacity such that the temperature controlled catalyst 1818 can be heated rapidly by the heater 1820. In some applications, the temperature controlled catalyst 1818 is composed of a plurality of thin plates (e.g., fins, etc.). For example, the temperature controlled catalyst 1818 may be constructed from a plurality of relatively thin parallel plates joined together either by end-caps or spanning members to form a cartridge-like structure. In some applications, the temperature controlled catalyst 1818 is constructed from a single sheet, or a plurality of sheets, that have been formed in a corrugated manner and overlapped with another portion of the same sheet or with an adjacent sheet. In some applications, the temperature controlled catalyst 1818 may be constructed from a material with a relatively low thermal capacitance (e.g., less than 0.4 Joules per gram-° C., etc.).

The heater 1820 may function as the heaters 400, the heaters 600, the heaters 706, and/or the heater 806 previously described. The heater 1820 is also configured to be heated such that a surface of the temperature controlled catalyst 1818, or a surface of the heater 1820, has a temperature that is greater than an activation temperature (e.g., 200° C. or more, etc.) of the temperature controlled catalyst 1818. In this way, the temperature controlled catalyst 1818 can be utilized to catalyze the exhaust gas without accumulating reductant deposits which would otherwise eventually cause a decomposition chamber to be undesirable.

A benefit of incorporating the temperature controlled catalyst 1818 in the decomposition reactor 1802 is that the heat given off by the heater 1820 to perform the hydrolysis is provided via the exhaust gas directly to downstream components of the exhaust gas aftertreatment system 1800, such as an SCR catalyst, thereby potentially increasing the conversion efficiency (e.g., ability to convert the exhaust gas into harmless byproducts, etc.) of these downstream components. This benefit is realized because the temperature controlled catalyst 1818 is positioned within the inner tube 1812 and does not utilize circuitous (e.g., curved, non-direct, lengthy, bent, etc.) piping to deliver the exhaust gas from the temperature controlled catalyst 1818 back into the decomposition reactor 1802. By avoiding the use of circuitous piping, the exhaust gas aftertreatment system 1800 avoids heat losses to the exhaust gas from the temperature controlled catalyst 1818 that would occur (e.g., due to the additional surface area of the circuitous piping, etc.) if circuitous piping were utilized in the exhaust gas aftertreatment system 1800, thereby providing additional heat to downstream components of the exhaust gas aftertreatment system 1800. Additionally, the exhaust gas aftertreatment system 100 avoids additional cost and complexity by not utilizing such circuitous piping. Furthermore, the exhaust gas aftertreatment system 1800 is able to have a smaller physical size because such circuitous piping is not utilized. Still further, by avoiding the use of circuitous piping, the flow of the exhaust gas from the temperature controlled catalyst 1818 remains substantially straight, thereby increasing the flow rate of the exhaust gas through the decomposition reactor 1802 and correspondingly increasing the efficiency of the exhaust gas aftertreatment system 1800.

In various embodiments, the heater 1820 is an electric heater (e.g., resistance heater, heating element, etc.) and is not a burner (e.g., combustion heater, etc.). As a result, the heater 1820 itself does not have any direct emissions (e.g., of combustion byproducts, etc.) into the exhaust gas.

In some embodiments, the temperature controlled catalyst 1818 is a titanium dioxide (e.g., $TiO_2$, etc.) catalyst. In such embodiments, the temperature controlled catalyst 1818 may be formed by sputter deposition of titanium dioxide, by physical vapor deposition of titanium dioxide, by plasma deposition of titanium dioxide, or another similar process. When the temperature controlled catalyst 1818 is a titanium dioxide catalyst, the heater 1820 may heat the temperature controlled catalyst 1818 to temperature of between 220° C. and 375° C., inclusive. At such temperatures, the temperature controlled catalyst 1818 may attain a decomposition rate that is between 20% and 40%, inclusive, higher than the decomposition rate attained in other catalysts used in typical exhaust gas aftertreatment systems. However, the temperature controlled catalyst 1818 may have other similar formulations or the heater 1820 may heat the temperature controlled catalyst 1818 to other temperatures, such as temperatures that are less than or equal to 200° C., such that the exhaust gas aftertreatment system 1800 is tailored for a target application.

The guide apertures 1817 may be configured such that a target amount of exhaust gas is received by the guide 1816, the target amount being a minimum amount of the exhaust gas necessary to drive the reductant from the injector 1810 into the inner tube 1812. By using only the minimum amount of the exhaust gas to drive the reductant into the inner tube 1812, only a minimum amount of heating by the heater 1820 is necessary, thereby decreasing the power consumption of the heater 1820 and making the exhaust gas aftertreatment system 1800 more efficient.

The heater 1820 is connected to a power source (e.g., an electrical system of an internal combustion engine associated with the exhaust gas aftertreatment system 1800, etc.) via wires (e.g., electrical wires, etc.). The wires are routed from outside of the body 1803 into the body 1803 and to the heater 1820. In some embodiments, the wires are routed through the body 1803 at a location proximate the guide 1816, along a downstream face of the guide 1816, across a top surface of the inner tube 1812, into the inner tube 1812 at a location proximate the heater 1820, and through the temperature controlled catalyst 1818 to the heater 1820. Such an arrangement may minimize exposure of the wires to the exhaust gas. In other embodiments, the wires are routed through the body 1803 at a location proximate the heater 1820, into the inner tube 1812 at a location proximate the heater 1820, and through the temperature controlled catalyst 1818 to the heater 1820.

In various embodiments, the decomposition reactor 1802 includes a swirl mixer 1822 (e.g., mixing plate, vane mixer, co-swirl mixer, counter-swirl mixer, etc.) coupled to the body 1803. The swirl mixer 1822 is positioned downstream of the flange 1814 and the temperature controlled catalyst 1818 and upstream of the outlet 1806. The swirl mixer 1822 is configured to facilitate mixing between the exhaust gas provided from the temperature controlled catalyst 1818 and the exhaust gas provided through the flange apertures 1815. The swirl mixer 1822 may be configured such that the decomposition reactor 1802 has a target backpressure and a target mixing length such that the decomposition reactor 1802 is tailored for a target application. In other embodiments, the decomposition reactor 1802 does not include the swirl mixer 1822.

V. Example Control System for Heater

Figure 20:
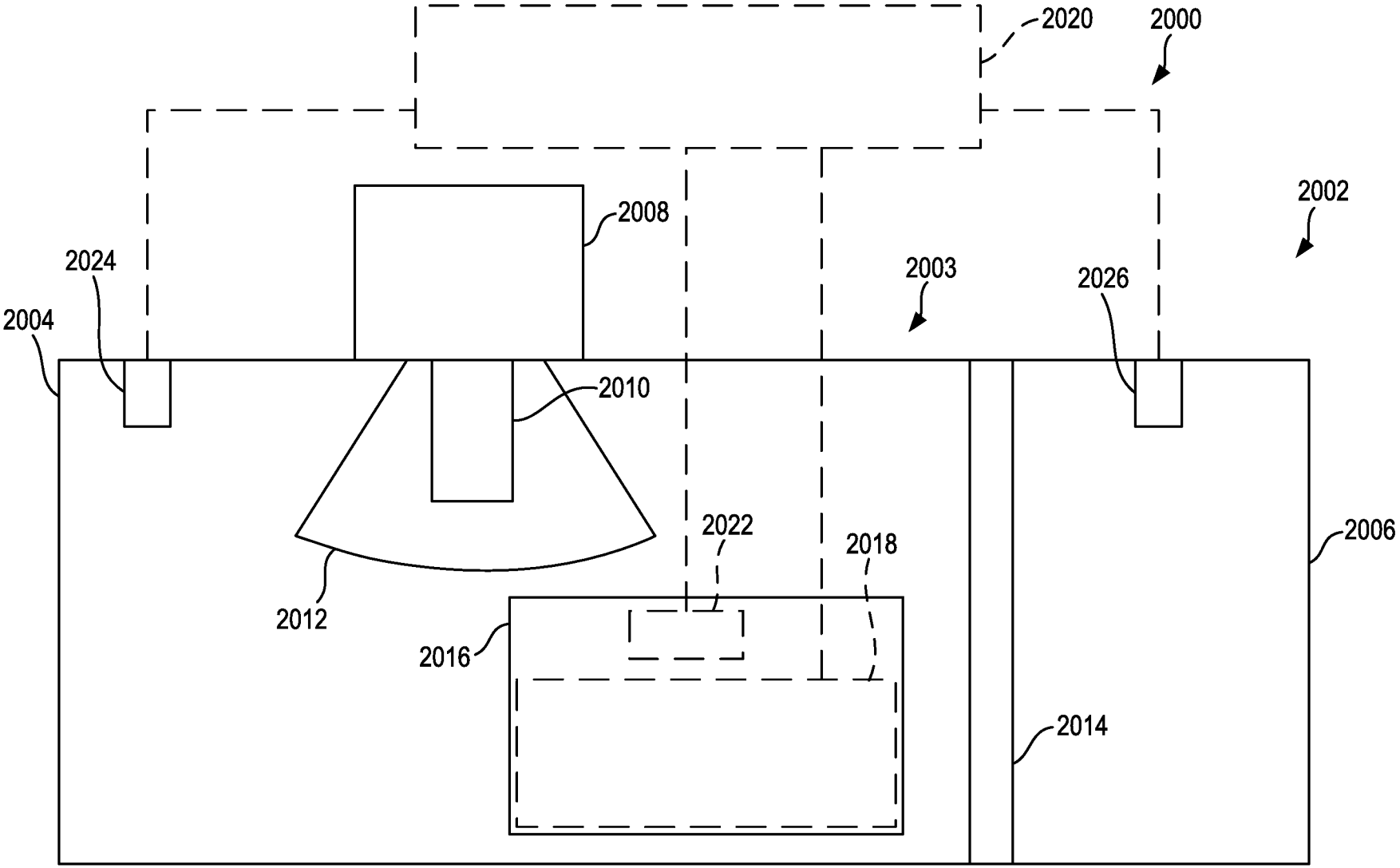
FIG. 20 is a cross-sectional view of an example decomposition reactor of an example exhaust gas aftertreatment system.

FIG. 20 illustrates an example exhaust gas aftertreatment system 2000. The exhaust gas aftertreatment system 2000 may be the exhaust gas aftertreatment system 200 or the exhaust gas aftertreatment system 100 previously described. The exhaust gas aftertreatment system 2000 includes a decomposition reactor 2002. The decomposition reactor 2002 may be the decomposition reactor 202 or the decomposition reactor 1802 previously described. The decomposition reactor 2002 has a body 2003 including an inlet 2004 and an outlet 2006. The inlet 2004 may be the inlet 204 or the inlet 1804 previously described. The outlet 2006 may be the outlet 206 or the outlet 1806 previously described.

The exhaust gas aftertreatment system 2000 includes a dosing module 2008. The dosing module may be the dosing module 208 or the dosing module 1008 previously described. The dosing module 2008 includes an injector 2010. The injector 2010 may be the injector 210 or the injector 1810 previously described.

In some embodiments, the decomposition reactor 2002 includes a guide 2012. Where the decomposition reactor 2002 includes the guide 2012, the guide 2012 may be the guide 704 or the guide 1016 previously described. In some embodiments, the decomposition reactor 2002 also includes a swirl mixer 2014. Where the decomposition reactor 2002 includes the swirl mixer 2014, the swirl mixer 2014 may be the swirl mixer 404, the swirl mixer 604, the swirl mixer 710, the swirl mixer 812, or the swirl mixer 1822.

The decomposition reactor 2002 also includes a selectively heated component 2016 coupled to the body 2003. The selectively heated component 2016 may be the impingement structure 214, the impingement structures 402, the impingement structures 602, the impingement structures 708, the impingement structure 808, or the temperature controlled catalyst 1818. The decomposition reactor 2002 also includes a heater 2018 coupled to the body 2003. The heater 2018 may be the heaters 400, the heaters 600, the heaters 706, the heater 806, or the heater 1020.

It is understood that the description of the exhaust gas aftertreatment system 2000 further describes the exhaust gas aftertreatment system 200 or the exhaust gas aftertreatment system 100 in some embodiments. For example, description of the selectively heated component 2016 is understood to further describe the impingement structures 602 in some embodiments or to further describe the temperature controlled catalyst 1818 in some embodiments.

The decomposition reactor 2002 includes a controller 2020. The controller 2020 may include a microprocessor, an application-specific integrated circuit (ASIC), a field-programmable gate array (FPGA), etc., or combinations thereof. The controller 2020 may include memory, which may include, but is not limited to, electronic, optical, magnetic, or any other storage or transmission device capable of providing a processor, ASIC, FPGA, etc. with program instructions. The memory may include a memory chip, Electrically Erasable Programmable Read-Only Memory (EEPROM), Erasable Programmable Read Only Memory (EPROM), flash memory, or any other suitable memory from which the controller 2020 can read instructions. The instructions may include code from any suitable programming language.

The controller 2020 is electrically or communicatively coupled to the heater 2018. The controller 2020 is configured to control the heater 2018 to selectively heat (e.g., to heat when desired, to not heat when desired, etc.) the selectively heated component 2016. For example, the controller 2020 may be configured to selectively vary an amount of electricity supplied to the selectively heated component 2016. As more electricity is supplied to the selectively heated component 2016, the selectively heated component 2016 may generate more heat. While not shown, it is understood that the selectively heated component may similarly include an on-board controller that is electrically or communicatively coupled to the heater 2018.

In some embodiments, the decomposition reactor 2002 includes a surface temperature sensor 2022. The surface temperature sensor 2022 is configured to measure a surface temperature of an external surface (e.g., an outer surface, an exposed surface, etc.) of the selectively heated component 2016. For example, the surface temperature sensor 2022 may measure a surface temperature of a surface of the impingement structure 214 or a surface temperature of the temperature controlled catalyst 1818. The surface temperature sensor 2022 is electrically or communicatively coupled to the controller 2020. For example, the controller 2020 may receive a measurement of the surface temperature of the temperature controlled catalyst 1818 from the surface temperature sensor 2022. The measurement of the surface temperature may be provided to the controller 2020 by the surface temperature sensor 2022 in response to the controller 2020 requesting a measurement of the surface temperature of the selectively heated component 2016 by the surface temperature sensor 2022.

The decomposition reactor 2002 includes an upstream temperature sensor 2024 coupled to the body 2003 and a downstream temperature sensor 2026 coupled to the body 2003. The upstream temperature sensor 2024 is positioned between the inlet 2004 and the selectively heated component 2016. The downstream temperature sensor 2026 is positioned between the selectively heated component 2016 and the outlet 2006. The upstream temperature sensor 2024 and the downstream temperature sensor 2026 are electrically or communicatively coupled to the controller 2020. The upstream temperature sensor 2024 is configured to measure a temperature of the exhaust gas upstream of the selectively heated component 2016 and the downstream temperature sensor 2026 is configured to measure a temperature of the exhaust gas downstream of the selectively heated component 2016. The controller 2020 may receive these measurements in response to a request sent by the controller to the upstream temperature sensor 2024 and the downstream temperature sensor 2026. In these embodiments, the controller 2020 also receives a parameter (e.g., mass flow rate of exhaust through the exhaust gas aftertreatment system 2000, etc.) and is configured to correlate the parameter, the temperature of the exhaust gas upstream of the selectively heated component 2016, and the temperature of the exhaust gas downstream of the selectively heated component 2016 to determine a surface temperature of the selectively heated component 2016 (e.g., instead of the surface temperature of the selectively heated component 2016 being measured by the surface temperature sensor 2022, etc.). In various embodiments, the upstream temperature sensor 2024 and the downstream temperature sensor 2026 are thermistors (e.g., high temperature thermistors, etc.). In some embodiments, the decomposition reactor 2002 does not include the surface temperature sensor 2022 when the decomposition reactor 2002 includes the upstream temperature sensor 2024 and the downstream temperature sensor 2026.

Figure 21:
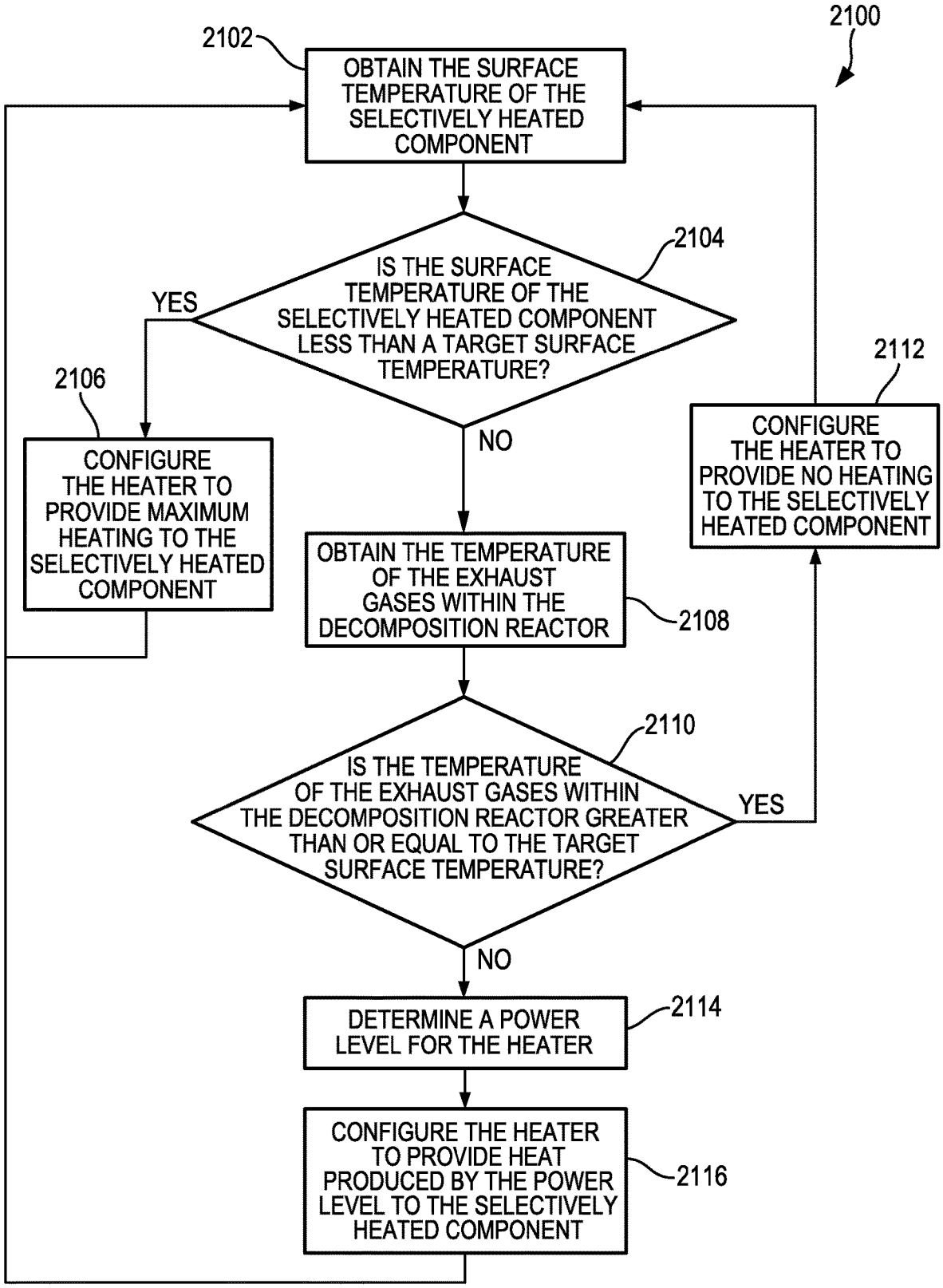
FIG. 21 is a block diagram for a heating strategy for a decomposition reactor of an example exhaust gas aftertreatment system.

Accordingly, either (i) the surface temperature sensor 2022 is used to directly obtain the surface temperature of the selectively heated component 2016 or (ii) the upstream temperature sensor 2024 and downstream temperature sensor 2026 are used to indirectly obtain the surface temperature of the selectively heated component 2016. Once the controller 2020 has surface temperature of the selectively heated component 2016, the controller 2020 implements a heating strategy 2100 to control the heater 2018. The heating strategy 2100 is shown in FIG. 21.

The heating strategy 2100 begins in block 2102 with obtaining, by the controller 2020, the surface temperature of the selectively heated component 2016 (e.g., via the surface temperature sensor 2022, via the upstream temperature sensor 2024 and the downstream temperature sensor 2026, etc.). For example, the controller 2020 may determine that the surface temperature of the selectively heated component 2016 is 180° C.

The heating strategy 2100 continues in block 2104 with determining, by the controller 2020, if the surface temperature of the selectively heated component 2016 is less than a target surface temperature. The target surface temperature may be downloaded to the controller 2020 (e.g., via a removable memory stick, via the internet, etc.) or may be determined by the controller 2020 (e.g., via machine learning, etc.). The target surface temperature may be determined based on a plot of the surface temperature of the selectively heated component 2016 as a function of film boiling on the selectively heated component 2016 or a plot of the surface temperature of the selectively heated component 2016 as a function of immediate decomposition on the selectively heated component 2016.

If the surface temperature of the selectively heated component 2016 is less than the target surface temperature, then the heating strategy 2100 continues in block 2106 with the controller 2020 configuring (e.g., instructing, providing with electricity, etc.) the heater 2018 to provide maximum heating to the selectively heated component 2016. The heating strategy 2100 then restarts with block 2102.

If the surface temperature of the selectively heated component 2016 is not less than the target surface temperature, the heating strategy 2100 continues in block 2108 with obtaining, by the controller 2020, the temperature of the exhaust gas within the decomposition reactor 2002. The temperature of the exhaust gas within the decomposition reactor 2002 is determined by the controller 2020 using the upstream temperature sensor 2024 and/or the downstream temperature sensor 2026. For example, the controller 2020 obtain a temperature reading from the upstream temperature sensor 2024 and determine that the temperature of the exhaust gas within the decomposition reactor 2002 is equal to the temperature reading.

The heating strategy 2100 continues, in block 2110, with determining, by the controller 2020, if the temperature of the exhaust gas within the decomposition reactor 2002 is greater than or equal to the target surface temperature. If the temperature of the exhaust gas within the decomposition reactor 2002 is greater than or equal to the target surface temperature, then the heating strategy 2100 continues in block 2112 with the controller 2020 configuring the heater 2018 to provide no heating to the selectively heated component 2016. The heating strategy 2100 then restarts with block 2102.

If the temperature of the exhaust gas within the decomposition reactor 2002 is less than the target surface temperature, then the heating strategy 2100 continues in block 2114 with determining a power level (e.g., a heater duty cycle, etc.) for the heater 2018. The power level for the heater 2018 is equal to the sum of the power loss to the exhaust gas and the power loss to the reductant cooling. In various embodiments, the power level for the heater 2018 is determined using conditions (e.g., temperature, flow rate, pressure, etc.) of the exhaust gas, a reductant dosing rate requirement, the surface temperature, and surface properties. The power level for the heater 2018 should be determined while factoring in heat transfer that occurs under film boiling conditions proximate the selectively heated component 2016. The heating strategy 2100 then continues in block 2116 with configuring the heater 2018 to provide heat produced by the power level to the selectively heated component 2016. The heating strategy 2100 then restarts with block 2102.

If the injector 2010 doses the exhaust gas before the temperature of the surface temperature is equal to the target temperature, the controller 2020 may be configured to configure the heater to continue to heat the selectively heated component 2016 after the temperature of the surface temperature is equal to the target temperature in order to decompose any deposits that may have formed on the selectively heated component 2016.

VII. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially," generally," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "attached," "fastened," "fixed," and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

The terms "fluidly coupled," "fluidly communicable with," and the like, as used herein, mean the two components or objects have a pathway formed between the two components or objects in which a fluid, such as air, liquid reductant, gaseous reductant, aqueous reductant, gaseous ammonia, etc., may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item unless specifically stated to the contrary.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X; Y; Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. An exhaust gas aftertreatment system comprising:

a decomposition reactor comprising:

a body through which exhaust gas is flowable, the body comprising:

an inlet configured to receive the exhaust gas at a first temperature, and an outlet configured to selectively expel the exhaust gas at a second temperature greater than the first temperature, an impingement structure disposed within the body between the inlet and the outlet, the impingement structure extending into the body and being located such that the exhaust gas flowing through the body impinges on the impingement structure, a heater coupled to the impingement structure and configured to selectively heat the impingement structure, and a guide coupled to the body downstream of the inlet, the guide comprising a plurality of guide apertures configured to receive the exhaust gas from the inlet;

an injector configured to inject reductant into the body; and a processor programmed to control the heater so as to heat the impingement structure to a third temperature that is greater than a Leidenfrost temperature of the reductant.

2. The exhaust gas aftertreatment system of claim 1, wherein:

the decomposition reactor comprises a splash plate, a swirl plate, or a mixer; and the impingement structure comprises a surface of the splash plate, the swirl plate, or the mixer.

3. The exhaust gas aftertreatment system of claim 1, wherein the injector is located upstream of the impingement structure.

4. The exhaust gas aftertreatment system of claim 1, further comprising a swirl mixer coupled to the body downstream of the impingement structure and upstream of the outlet, the swirl mixer configured to swirl the exhaust gas passing therethrough.

5. The exhaust gas aftertreatment system of claim 1, further comprising:

a flange coupled to the body downstream of the guide; and an inner tube coupled to the flange and the guide, the inner tube being configured to separately receive the exhaust gas from the inlet and the guide, and to provide the exhaust gas through the flange and towards the outlet.

6. The exhaust gas aftertreatment system of claim 5, wherein the flange comprises a plurality of flange apertures configured to receive the exhaust gas from the inlet and to provide the exhaust gas through the flange and towards the outlet.

7. The exhaust gas aftertreatment system of claim 5, wherein the impingement structure is at least partially disposed within at least one of the inner tube or the guide.

8. The exhaust gas aftertreatment system of claim 7, wherein the impingement structure is coupled to at least one of the inner tube or the guide.

9. An exhaust gas aftertreatment system comprising:

a decomposition reactor comprising:

a body through which exhaust gas is flowable, the body comprising:

an inlet configured to receive the exhaust gas, and an outlet configured to selectively expel the exhaust gas;

a guide coupled to the body downstream of the inlet, the guide extending into the body and comprising a plurality of guide apertures configured to receive the exhaust gas from the inlet;

a flange coupled to the body downstream of the guide;

an inner tube coupled to the flange and the guide, the inner tube being configured to separately receive the exhaust gas from the inlet and the guide, and to provide the exhaust gas through the flange and towards the outlet;

a temperature controlled catalyst disposed within the inner tube downstream of the guide, the temperature controlled catalyst being located such that the exhaust gas passing through the inner tube towards the outlet impinges on the temperature controlled catalyst; and a heater coupled to the temperature controlled catalyst and configured to selectively heat the temperature controlled catalyst; and a processor programmed to control the heater so as to heat the temperature controlled catalyst to perform hydrolysis of the exhaust gas that impinges on the temperature controlled catalyst.

10. The exhaust gas aftertreatment system of claim 9, wherein the inner tube and the body are coaxial such that the temperature controlled catalyst is centered on a central axis of the body.

11. The exhaust gas aftertreatment system of claim 9, wherein the guide, the inner tube, the flange, the temperature controlled catalyst, and the heater are contained within the body.

12. The exhaust gas aftertreatment system of claim 9, further comprising a swirl mixer coupled to the body downstream of the inner tube and upstream of the outlet, the swirl mixer configured to swirl the exhaust gas passing therethrough.

13. A decomposition reactor for an exhaust gas aftertreatment system, the decomposition reactor comprising:

an inlet configured to receive an exhaust gas;

an outlet configured to provide the exhaust gas;

a body extending between the inlet and the outlet;

an inner tube positioned within the body such that at least a portion of the inner tube is separated from the body by an air gap extending around the inner tube, the inner tube comprising an impingement structure positioned proximate the inlet;

a distribution plate coupled to the impingement structure; and a first heater coupled to the distribution plate;

wherein the distribution plate separates the first heater from the impingement structure.

14. The decomposition reactor of claim 13, further comprising:

a second heater coupled to the distribution plate, the second heater separated from the first heater by a gap;

wherein the distribution plate separates the second heater from the impingement structure; and wherein the distribution plate extends between the first heater and the second heater.

15. The decomposition reactor of claim 13, further comprising:

a plurality of vanes, each of the plurality of vanes coupled to the inner tube proximate a downstream end of the inner tube;

wherein the inner tube further comprises an injector aperture that is located between the downstream end and the impingement structure; and wherein the injector aperture is configured to receive an injector.

16. The decomposition reactor of claim 13, further comprising:

a mixing plate coupled to the inner tube, the mixing plate comprising a mixing plate aperture configured to facilitate passage of the exhaust gas through the mixing plate and a mixing plate channel configured to facilitate passage of the exhaust gas through the mixing plate, the mixing plate channel configured to cause the exhaust gas exiting the mixing plate channel to swirl downstream of the mixing plate;

wherein the inner tube further comprises:

an upstream end; and a downstream end opposite the upstream end; and wherein the impingement structure is disposed between the upstream end and the mixing plate.

17. The decomposition reactor of claim 16, wherein the inner tube further comprises an injector aperture disposed between the upstream end and the mixing plate.

18. The decomposition reactor of claim 17, wherein the injector aperture is aligned with the impingement structure.

19. The decomposition reactor of claim 16, wherein the first heater is configured to heat the impingement structure to a temperature that is between 120 degrees Celsius and 151 degrees Celsius, inclusive.

* * * * *